US008052146B2

(12) United States Patent
Sugiyama et al.

(10) Patent No.: US 8,052,146 B2
(45) Date of Patent: Nov. 8, 2011

(54) SHEET TRANSPORT APPARATUS

(75) Inventors: Yoshihide Sugiyama, Kinokawa (JP); Kazuya Yamamoto, Kinokawa (JP); Katsunori Takahashi, Kinokawa (JP); Hidemasa Kanada, Suwa (JP); Junichi Kakuta, Suwa (JP)

(73) Assignees: Duplo Seiko Corporation, Wakayama (JP); Seiko Epson Corporation, Tokyo (JP)

( * ) Notice: Subject to any disclaimer, the term of this patent is extended or adjusted under 35 U.S.C. 154(b) by 288 days.

(21) Appl. No.: 12/450,243

(22) PCT Filed: Aug. 28, 2008

(86) PCT No.: PCT/JP2008/002330

§ 371 (c)(1), (2), (4) Date: Sep. 17, 2009

(87) PCT Pub. No.: WO2009/031279

PCT Pub. Date: Mar. 12, 2009

(65) Prior Publication Data

US 2010/0109235 A1 May 6, 2010

(30) Foreign Application Priority Data

Sep. 7, 2007 (JP) ..... 2007-232473

(51) Int. Cl.
*B65H 5/02* (2006.01)

(52) U.S. Cl. ..... 271/276

(58) Field of Classification Search ..... 271/276
See application file for complete search history.

(56) References Cited

U.S. PATENT DOCUMENTS

| | | | | |
|---|---|---|---|---|
| 4,078,489 | A | 3/1978 | Davis | |
| 4,362,380 | A * | 12/1982 | Dragstedt | 271/276 |
| 4,997,178 | A * | 3/1991 | Ogoda | 271/276 |
| 5,461,467 | A * | 10/1995 | Malachowski | 271/276 |
| 5,921,544 | A * | 7/1999 | Benedict | 271/276 |
| 7,584,957 | B2 * | 9/2009 | Edinger | 271/276 |
| 2002/0158410 | A1 * | 10/2002 | Dolz et al. | 271/276 |
| 2007/0216083 | A1 * | 9/2007 | Kawashima et al. | 271/97 |

FOREIGN PATENT DOCUMENTS

| | | |
|---|---|---|
| JP | 05-078000 | 3/1993 |
| JP | 05-107968 | 4/1993 |
| JP | 06-025460 | 7/1994 |
| JP | 08-091624 | 4/1996 |
| JP | 2002-103768 | 4/2002 |
| JP | 2004-001290 | 1/2004 |

* cited by examiner

*Primary Examiner* — Gerald McClain
(74) *Attorney, Agent, or Firm* — Fildes & Outland, P.C.

(57) ABSTRACT

Provided is a sheet inverting apparatus wherein members, such as a roller, are not brought into contact with the printed surface of a sheet at all, and the occurrence of dirt can be prevented by eliminating friction of ink on the surface of the sheet. A first transport apparatus and a second transport apparatus each have a plurality of transport belts which move on transport tracks along sheet transport directions and a suction box which sucks the sheet on the transport belts through suction holes formed on the transport belts. A turn guide arranged between the first transport apparatus and the second transport apparatus has a plurality of guide ribs disposed between the transport belts. Each of the guide ribs coming into slidable contact with the sheet forms a curved inverting transfer surface from an inversion starting point side to an inversion end point side.

7 Claims, 29 Drawing Sheets

SHEET TRANSPORT APPARATUS

TECHNICAL FIELD

The present invention relates to a sheet transport apparatus and a technique for transporting a sheet of paper in a printer and so on.

BACKGROUND ART

Such an apparatus of the prior art is described in, for example, Japanese Patent Laid-Open No. 2-123065. In this invention, a transport apparatus for transporting a transfer sheet includes a suction device for sucking the transfer sheet and a switching device for switching the suction force according to the stiffness of the transfer sheet.

In an apparatus described in Japanese Utility Model Laid-Open No. 5-5755, a suction duct including a suction fan is provided to suck air from the inside of an exposure house and the sucked air is exhausted in a circulating manner from an air outlet to the top surface of a sheet photosensitive material through an air supply duct extending upward along the optical axis of the exposure house.

In an apparatus described in Japanese Utility Model Publication No. 7-29074, a belt is provided for scanning in a certain direction a side of a substrate having air suction holes formed thereon, a plurality of suction ducts are extended so as to cross the scanning direction of the belt and are connected to an exhausting device, and the exhaust holes of the suction ducts are reduced in cross-sectional area as the air suction holes of the suction ducts come closer to the exhausting device.

In an apparatus described in Japanese Patent Laid-Open No. 2006-89223, the inside of a chamber is divided into two adjacent spaces by a diaphragm, air is passed through an upstream chamber to generate a suction force in a transport direction upstream from an image forming region, and air is passed through a chamber for the image forming region to generate a suction force in the image forming region and downstream of the image forming region.

DISCLOSURE OF THE INVENTION

Problems to be Solved by the Invention

In such an apparatus for transporting a sheet of paper by means of suction, a fan device is provided to generate a suction force. When the exhaust point of air sucked by the fan device is improperly set, the transportation of the sheet may be adversely affected.

For this reason, in the apparatus described in Japanese Patent Laid-Open No. 2-123065, a shutter member is provided at some point of a duct and the shutter member is opened and closed with a solenoid to adjust an amount of air exhausted. Further, in the apparatus described in Japanese Utility Model Laid-Open No. 5-5755, air is exhausted to the top surface of an object in a circulating manner. Moreover, in the apparatus described in Japanese Utility Model Publication No. 7-29074, air is exhausted to a side of a suction conveyor.

Generally, in order to change a suction force of a predetermined range at a point of a transport path, a plurality of fan devices are provided and the suction forces of the fan devices are adjusted. In this configuration, however, the cost is increased. Thus as described in Japanese Patent Laid-Open No. 2006-89223, a plurality of regions are sucked by a single fan device and the suction force is adjusted through inlet pipes having various internal diameters and communicating with the respective regions.

In the foregoing configurations, it is possible to prevent exhausted air from adversely affecting the transportation of a sheet. However, the exhausted air cannot effectively act on the transportation of the sheet.

The present invention has been devised to solve the foregoing problem. An object of the present invention is to provide a sheet transport apparatus in which air exhausted during the transportation of a sheet of paper by means of suction can be used for the transportation of the sheet.

Means for Solving the Problems

In order to solve the problem, a sheet transport apparatus of the present invention includes a suction device for sucking a sheet of paper on transport belts through suction holes formed on the transport belts, the suction device including: a plurality of suction boxes disposed along a sheet transport direction; a suction fan device; an inlet pipe having one end communicating with the suction side of the suction fan device and a plurality of air inlets branched on the other end so as to communicate with the respective suction boxes; and an exhaust pipe having one end communicating with the exhaust side of the suction fan device and a plurality of air exhaust nozzles branched on the other end so as to be opened above the respective suction boxes, wherein air is jetted from the air exhaust nozzles to the sheet sucked on the transport belts.

Further, the air exhaust nozzles of the exhaust pipe are opened in the sheet transport direction and air is jetted downstream in the sheet transport direction from the air exhaust nozzles.

Moreover, the inlet pipe has air intake amount limiting members or the suction boxes have openings of predetermined shapes to limit air intake amounts such that the total amount of air intake amounts through the branched conduits of the inlet pipe is smaller than the maximum air intake (capacity) amount of the suction fan device.

Further, the sheet transport apparatus includes air pressure detection sensors and air intake amount adjusting valves near the air inlets of the inlet pipe, air flow rate detection sensors and air exhaust amount adjusting valves near the air exhaust nozzles of the exhaust pipe, and a controller for controlling the opening of the air intake amount adjusting valve according to the detected value of the air pressure detection sensor and the opening of the air exhaust amount adjusting valve according to the detected value of the air flow rate detection sensor.

Moreover, the sheet transport apparatus includes a sensor device for detecting the transport position of the sheet, and the controller adjusts, based on the output of the sensor device, at least one of air intake timing for sucking air from the openings of the suction boxes and exhaust timing for jetting air from the air exhaust nozzles to the sheet on the transport belts.

Further, the sheet transport apparatus includes a heating device in a conduit upstream from the branch point of the exhaust pipe.

Moreover, the sheet transport apparatus includes an external exhaust valve communicating with a conduit upstream from the branch point of the exhaust pipe, and an air pressure detection sensor in a conduit upstream from the external exhaust valve.

Further, the sheet transport apparatus includes a controller for controlling the suction force of the suction fan device according to the kind of sheet.

Advantage of the Invention

As has been discussed, the present invention can achieve air intake and exhaust with a single suction fan device. Air jetted from the air exhaust nozzles of an exhaust pipe is directed to a sheet of paper on transport belts, thereby preventing a sheet end from being lifted. Further, stable air intake and exhaust can be achieved by controlling the opening of an air intake amount adjusting valve according to the detected value of an air pressure detection sensor and the opening of an air exhaust amount adjusting valve according to the detected value of an air flow rate detection sensor. Heated air is jetted from the air exhaust nozzles to the sheet on the transport belts, thereby accelerating drying on the printed surface of the sheet. When an external exhaust valve is opened to exhaust air, the sheet on the transport belts can be just sucked. Alternatively, the pressure of air jetted from the air exhaust nozzles to the sheet on the transport belts can be adjusted by adjusting the opening of the external exhaust valve.

BEST MODE FOR CARRYING OUT THE INVENTION

The following will describe embodiments of the present invention in accordance with the accompanying drawings. First, referring to FIGS. 22 to 26, the application of a sheet inverting apparatus and the transport path of a sheet of paper will be discussed according to the present invention.

Figure 22:
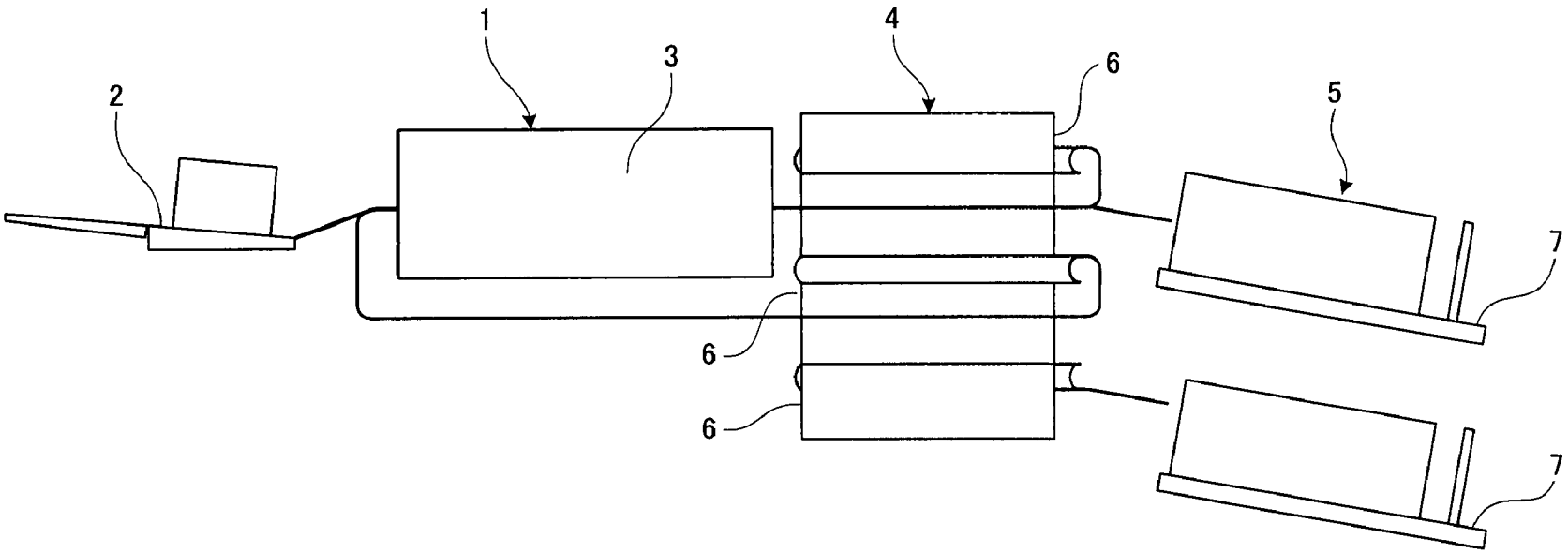
FIG. 22 is a schematic diagram showing a transport path of a sheet according to the embodiment of the present invention.
Figure 23:
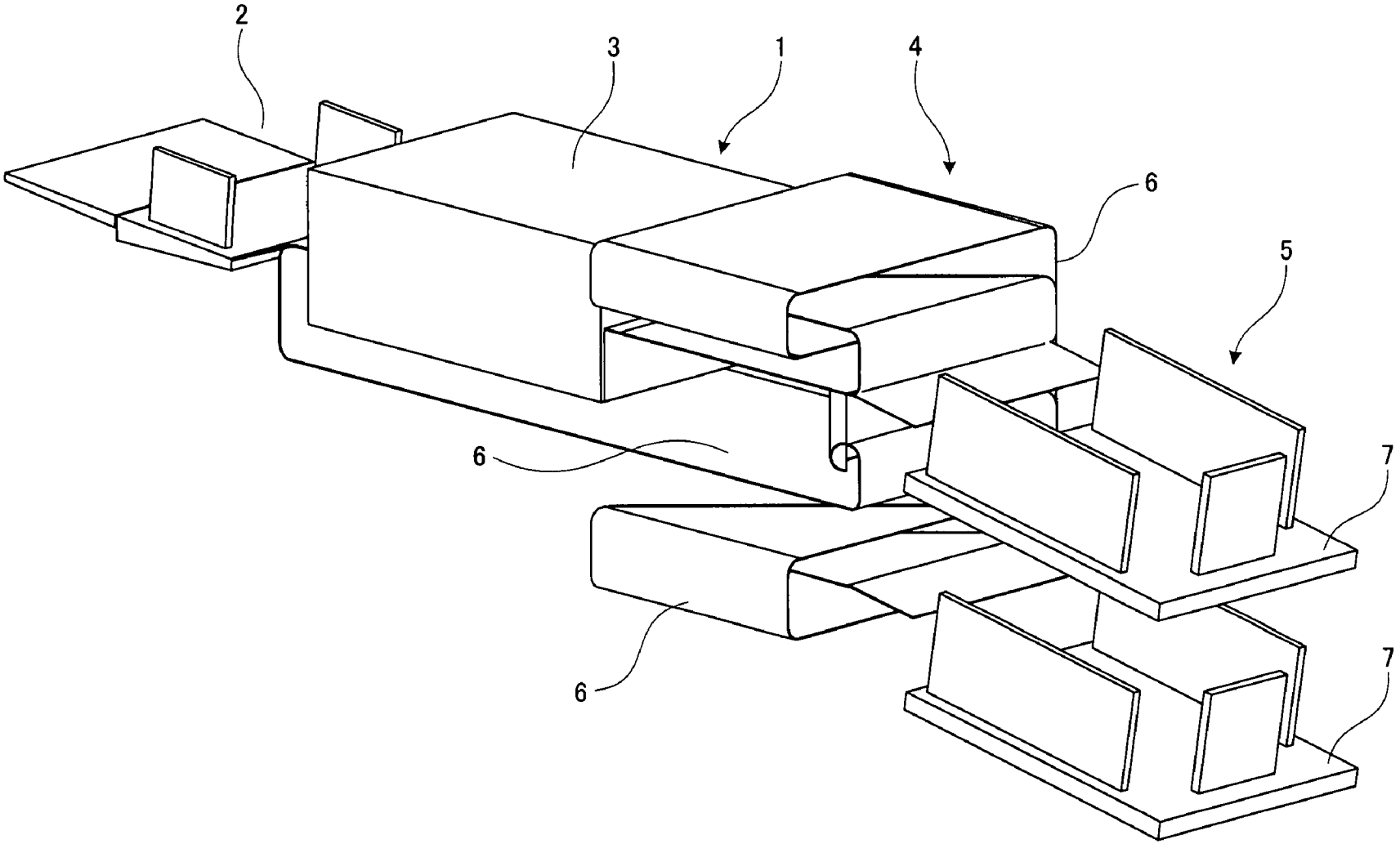
FIG. 23 is a schematic diagram showing the transport path of the sheet according to the embodiment of the present invention.

FIGS. 22 and 23 illustrate an ink jet printer as an application of the sheet inverting apparatus of the present invention. The present invention is also applicable to a stencil duplicator, a screen printer, and so on.

(Overall Configuration)

An ink jet printer 1 is made up of a sheet feed mechanism 2, a printer body 3, a sheet inverting mechanism 4, and a sheet receiving mechanism 5. In this configuration, the printer body 3 performs printing by jetting water-based ink to a surface of a sheet of paper according to an inkjet printing system. The sheet inverting mechanism 4 is a combination of a plurality of inverting transfer units 6 which are respectively disposed on the top stage, the middle stage, and the bottom stage, so that a plurality of transport paths can be selectively formed. The sheet receiving mechanism 5 is made up of a plurality of sheet receiving units 7. Sheets of paper ejected from the sheet inverting mechanism 4 are received by the sheet receiving units 7 which selectively correspond to the plurality of transport paths formed in the sheet inverting mechanism 4.

(Single-sided Printing)

Figure 24:
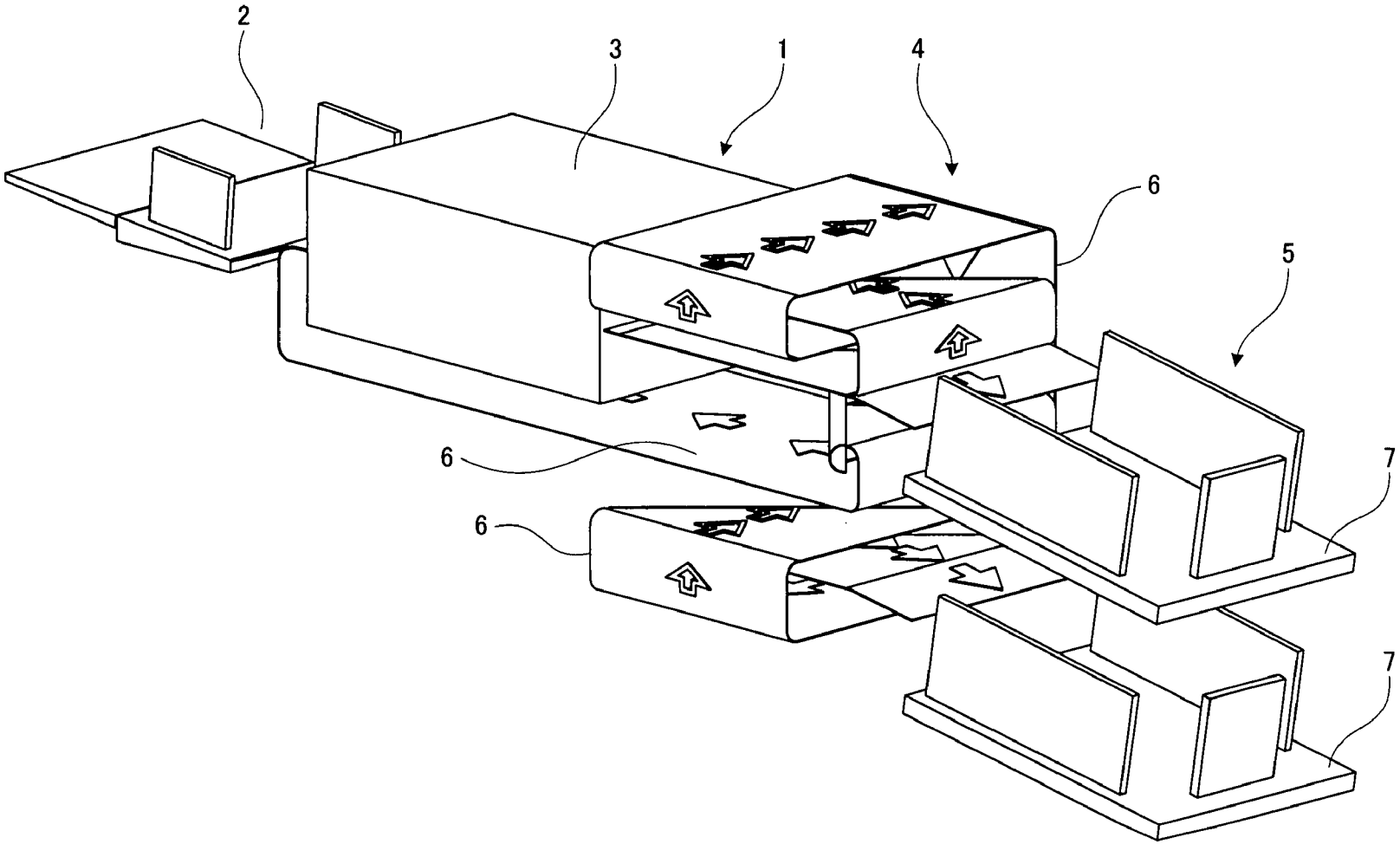
FIG. 24 is a schematic diagram showing the transport path of the sheet according to the embodiment of the present invention.
Figure 25:
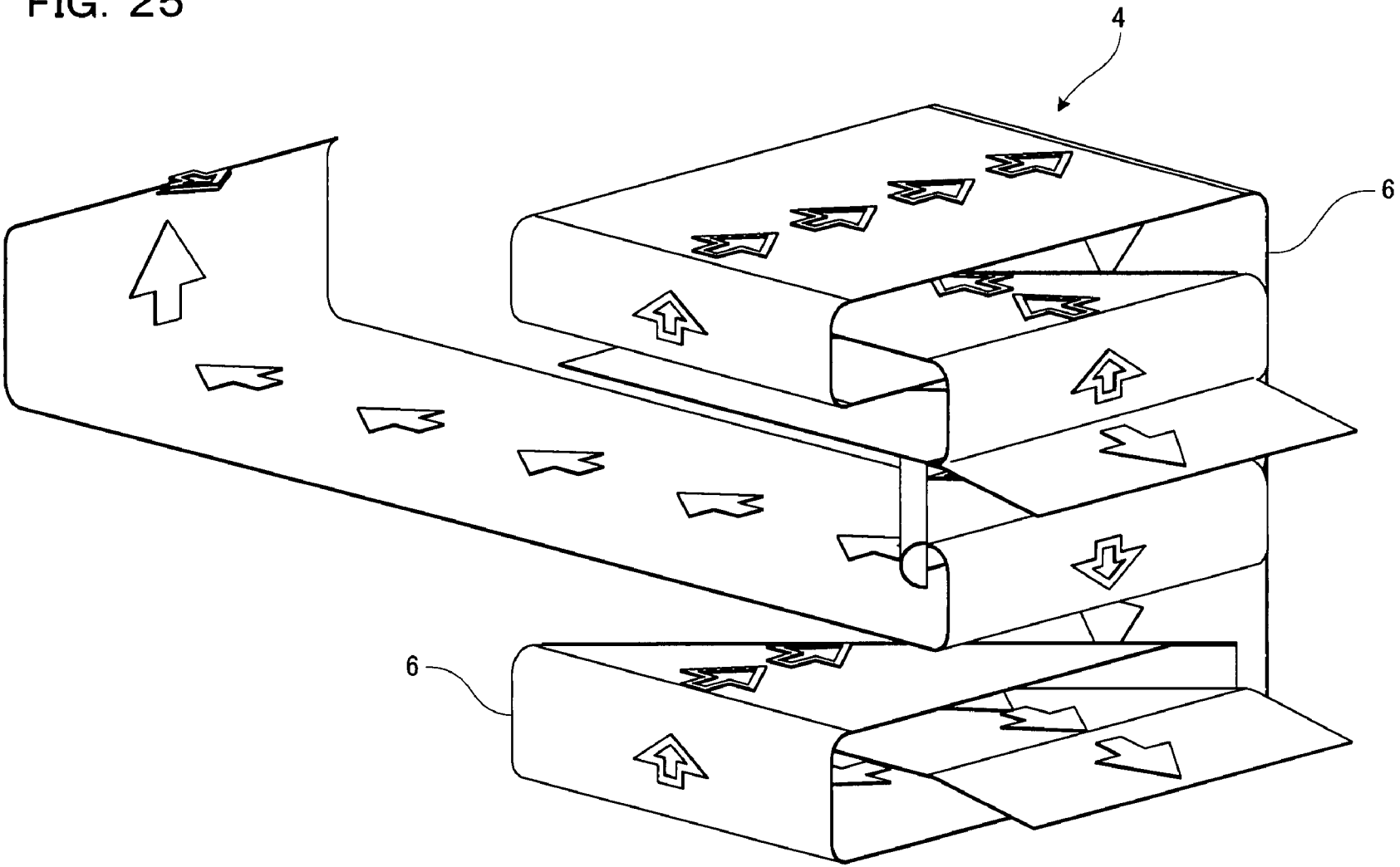
FIG. 25 is a schematic diagram showing the transport path of the sheet according to the embodiment of the present invention.
Figure 26:
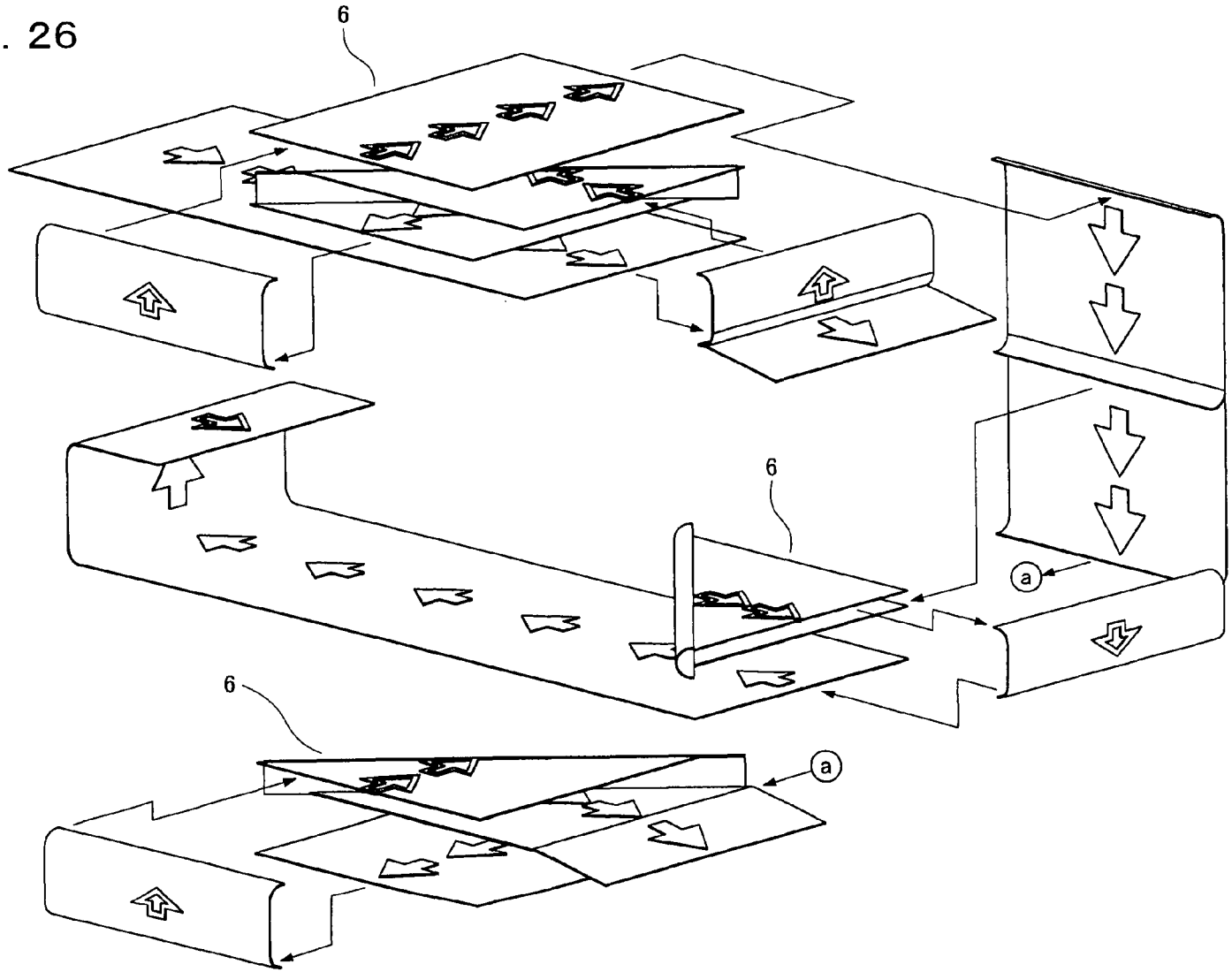
FIG. 26 is a schematic diagram showing the transport path of the sheet according to the embodiment of the present invention.

As shown in FIGS. 24 to 26, the sheet feed mechanism 2 feeds sheets of paper one by one to the printer body 3. One side of the sheet is printed in the printer body 3 and the printed sheet is ejected to the sheet receiving unit 7 through the sheet inverting mechanism 4. When the sheet is ejected to the sheet receiving unit 7 in the shortest time after the sheet is printed in the printer body 3, the sheet is passed through the inverting transfer unit 6 on the top stage of the sheet inverting mechanism 4 without being inverted and then the sheet reaches the sheet receiving unit 7.

After printed in the printer body 3, when the sheet of paper has to be kept in the sheet inverting mechanism 4 for a longer time to dry the printed surface of the sheet, the sheet is inverted by the inverting transfer unit 6 on the top stage of the sheet inverting mechanism 4, is transferred to the inverting transfer unit 6 on the bottom stage, is inverted by the inverting transfer unit 6 on the bottom stage, and then reaches the lower sheet receiving unit 7.

(Double-sided Printing)

The sheet feed mechanism 2 feeds sheets of paper one by one to the printer body 3. One side of the sheet is printed in the printer body 3. After printed in the printer body 3, the sheet is inverted in the inverting transfer unit 6 on the top stage of the sheet inverting mechanism 4, is inverted by the inverting transfer unit 6 on the middle stage, and then is returned to the feed port of the printer body 3. After that, the other side of the sheet is printed in the printer body 3. After printed in the printer body 3, the sheet is inverted in the inverting transfer unit 6 on the top stage of the sheet inverting mechanism 4, is transferred to the inverting transfer unit 6 on the bottom stage, is inverted by the inverting transfer unit 6 on the bottom stage, and then reaches the lower sheet receiving unit 7.

Figure 27:
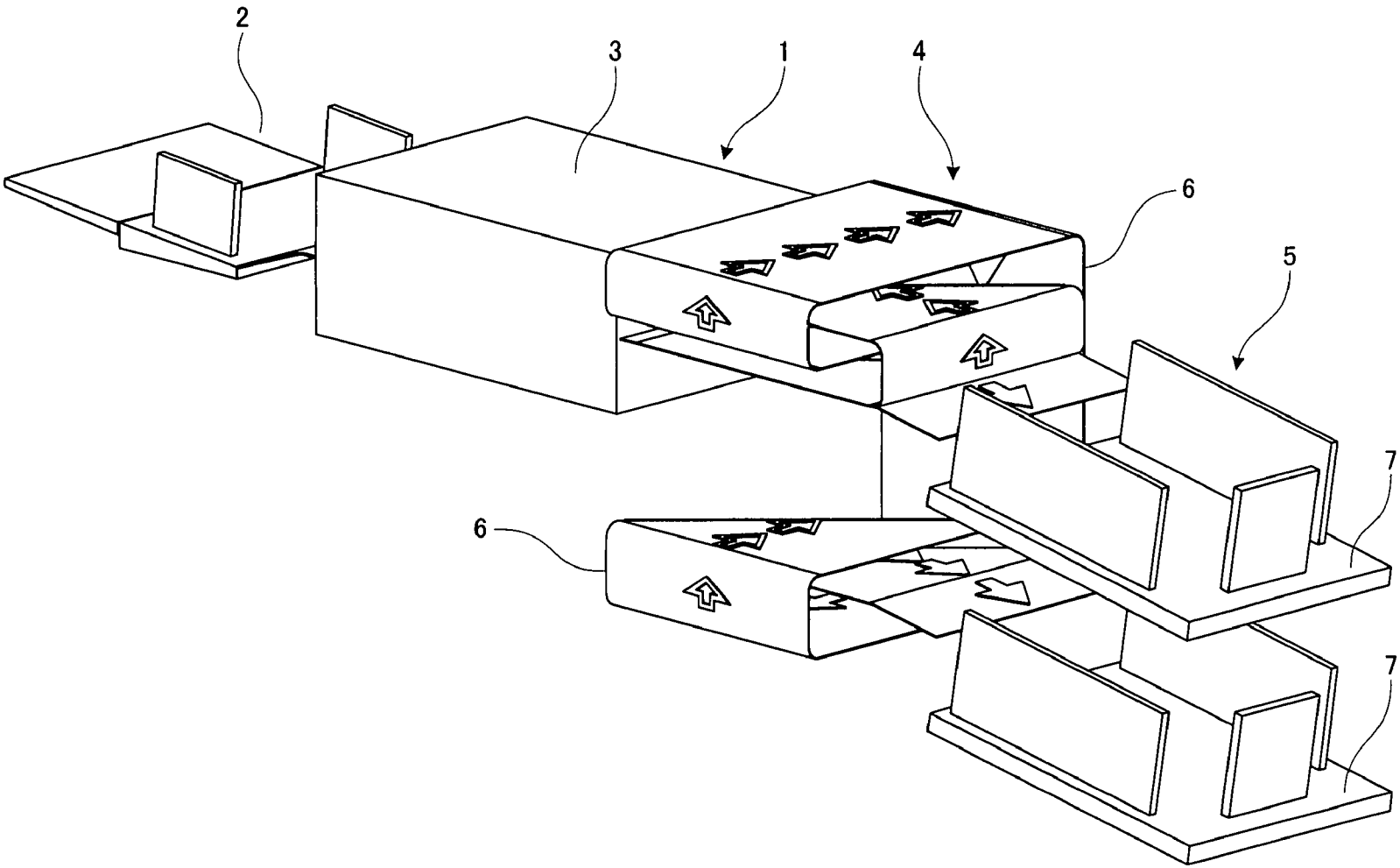
FIG. 27 is a schematic diagram showing a transport path of a sheet according to the embodiment of the present invention.
Figure 28:
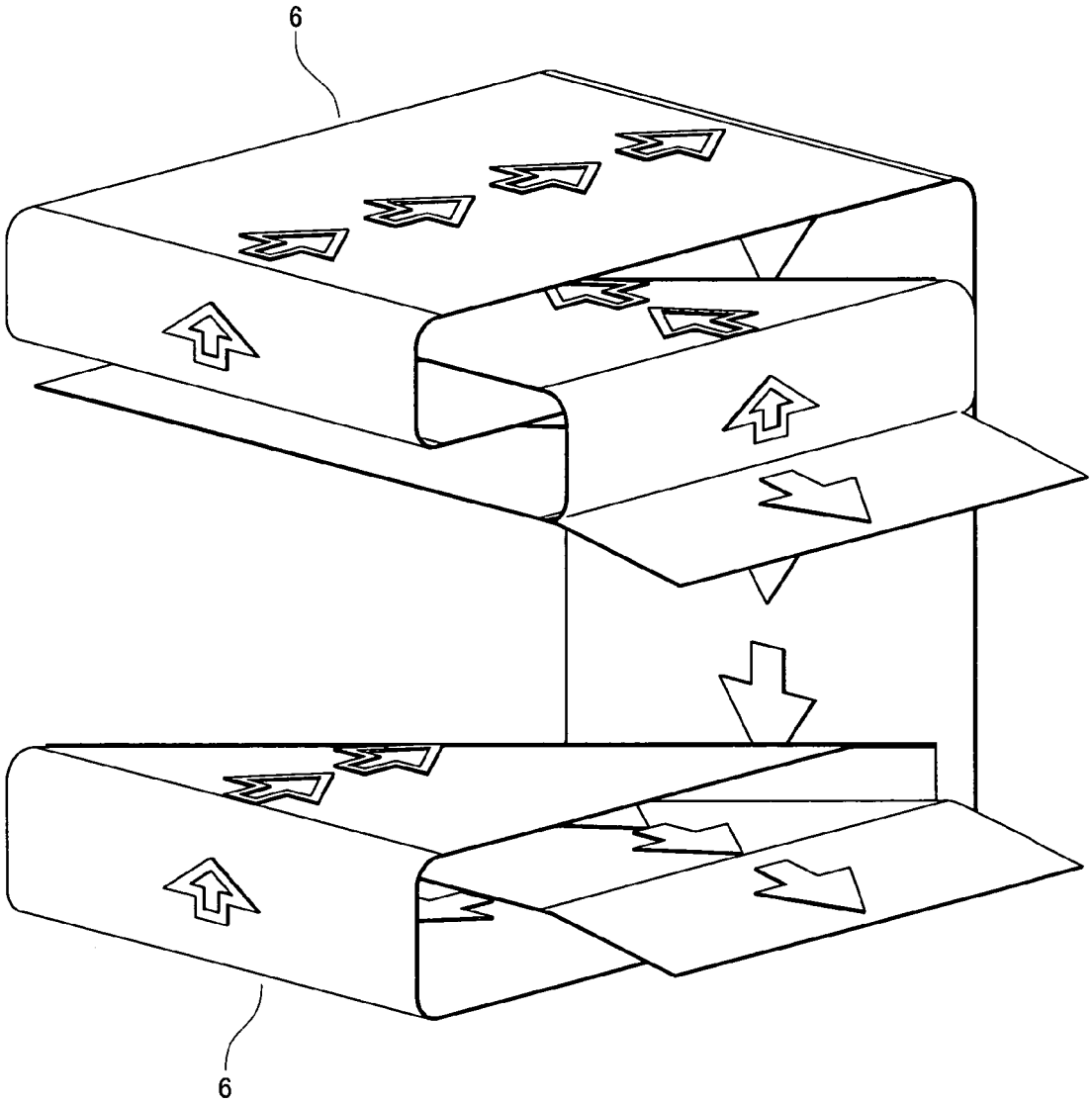
FIG. 28 is a schematic diagram showing the transport path of the sheet according to the embodiment of the present invention.
Figure 29:
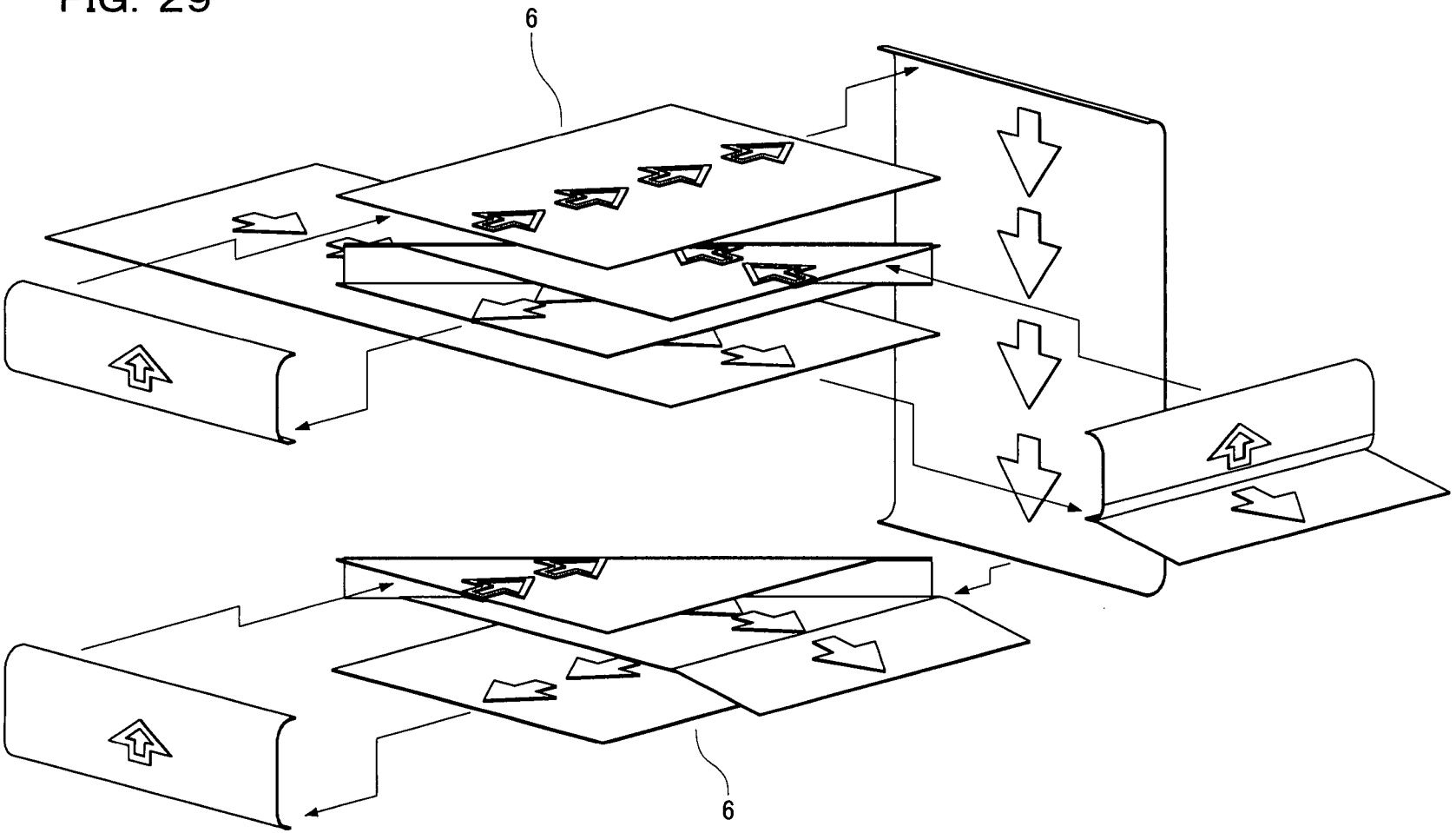
FIG. 29 is a schematic diagram showing the transport path of the sheet according to the embodiment of the present invention.

Referring to FIGS. 27 to 29, another application of the sheet inverting apparatus of the present invention will be described below.

(Overall Configuration)

In the following explanation, the same constituent elements as the constituent elements of the foregoing configuration are indicated by the same reference numerals. In this configuration, the sheet inverting mechanism is a combination of the upper and lower inverting transfer units 6 which can selectively form a plurality of transport paths.

(Single-sided Printing)

As shown in FIGS. 27 to 29, a sheet feed mechanism 2 feeds sheets of paper one by one to a printer body 3. One side of the sheet is printed in the printer body 3 and the printed sheet is ejected to a sheet receiving unit 7 through a sheet inverting mechanism 4. When the sheet is ejected to the sheet receiving unit 7 in the shortest time after the sheet is printed in the printer body 3, the sheet is passed through the upper inverting transfer unit 6 of the sheet inverting mechanism 4 without being inverted, and then the sheet reaches the sheet receiving unit 7.

After printed in the printer body 3, when the sheet of paper has to be kept in the sheet inverting mechanism 4 for a longer time to dry the printed surface of the sheet, the sheet is inverted by the upper inverting transfer unit 6 of the sheet inverting mechanism 4, is transferred to the lower inverting transfer unit 6, is inverted by the lower inverting transfer unit 6, and then reaches the lower sheet receiving unit 7.

Figure 1:
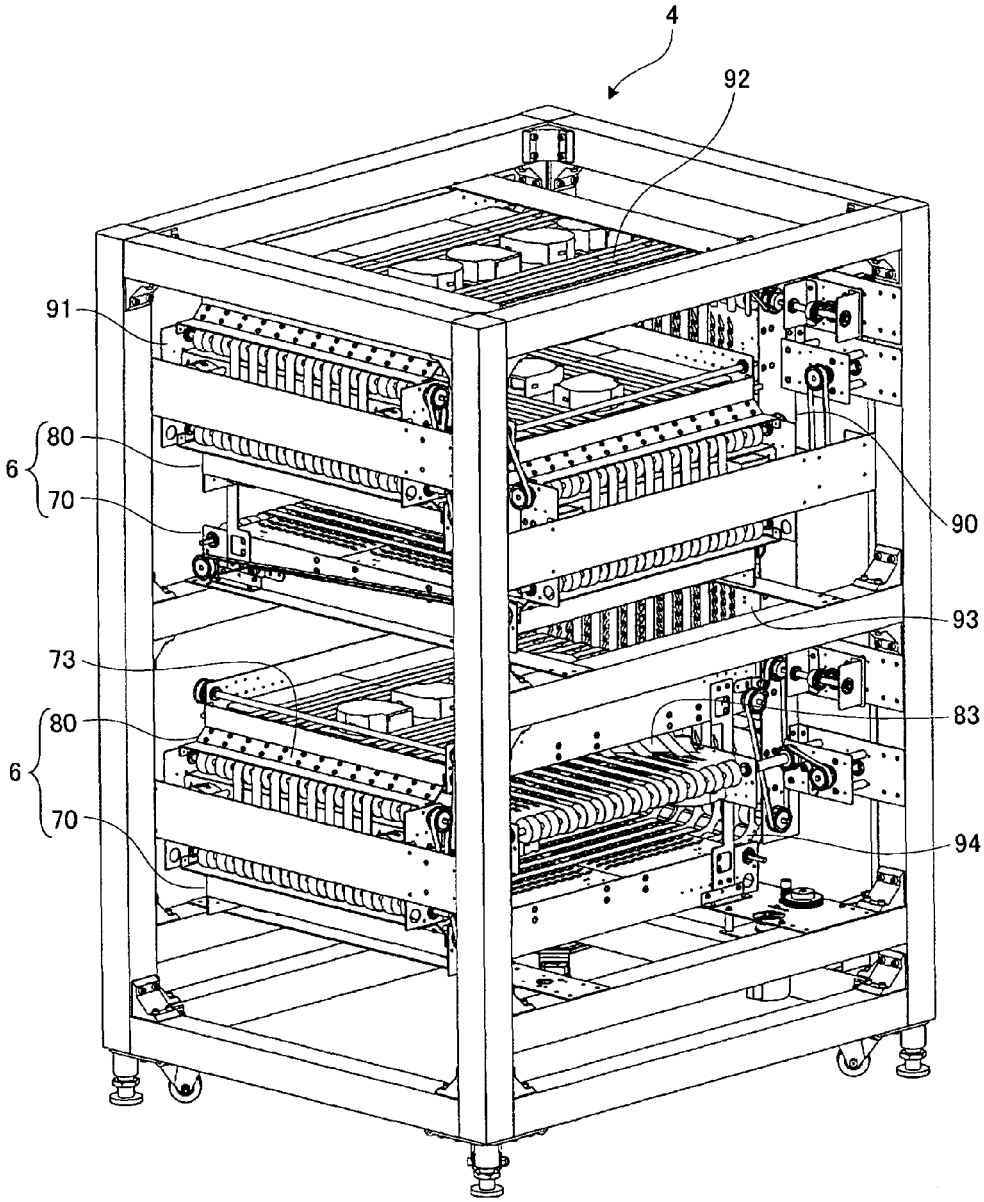
FIG. 1 is a perspective view showing a sheet inverting apparatus according to an embodiment of the present invention.

Referring to FIGS. 1 to 7, the sheet inverting mechanism 4 of the present invention will be specifically described below. In FIG. 1, the sheet inverting mechanism 4 includes the plurality of inverting transfer units 6 which are vertically stacked. Each of the inverting transfer units 6 includes a first sheet inverting apparatus 70 and a second sheet inverting apparatus 80, and a third sheet inverting apparatus 90 is provided between the upper and lower inverting transfer units 6. The sheet inverting mechanism 4 shown in FIGS. 1 to 7 does not have a mechanism of returning sheets of paper to the printer body 3 but such a mechanism can be easily realized according to the following explanation.

Figure 2:
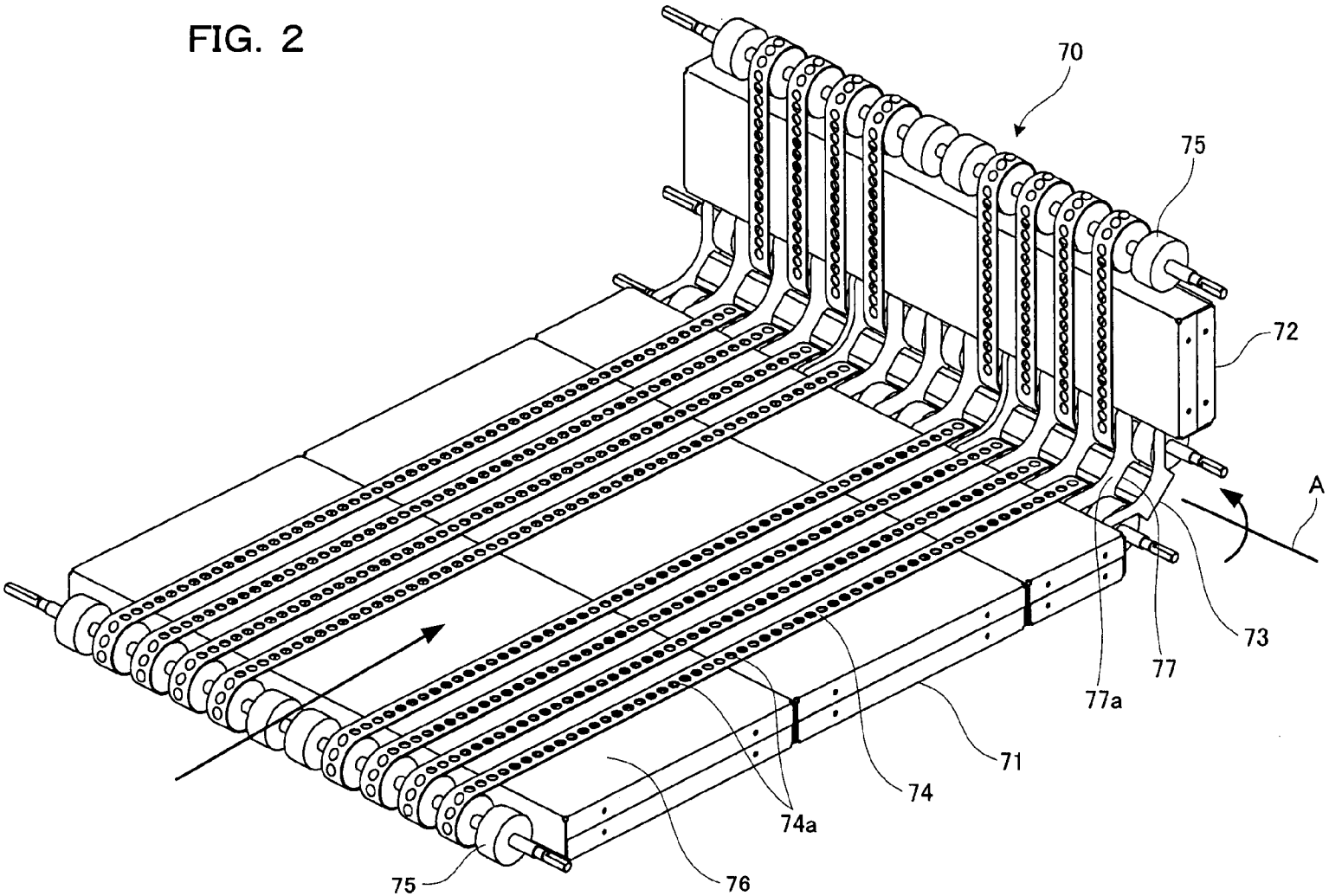
FIG. 2 is a perspective view showing a first sheet inverting apparatus according to the embodiment.

As shown in FIG. 2, the first sheet inverting apparatus 70 includes a first transport apparatus 71 forming a first transport surface on which a sheet of paper is transported in the horizontal direction, a second transport apparatus 72 forming a second transport surface on which a sheet of paper is transported in a direction orthogonal to the first transport surface, and a turn guide 73 for inverting a sheet of paper about an inversion axis A by a predetermined inversion angle, in this case, by 90° when the sheet is transferred from the first transport surface to the second transport surface.

The first transport apparatus 71 and the second transport apparatus 72 include a plurality of transport belts 74 moving on transport tracks along paper transport directions. The transport belts 74 are each made up of an endless belt looped over belt rollers 75 disposed on both ends of the transport track.

Figure 8:
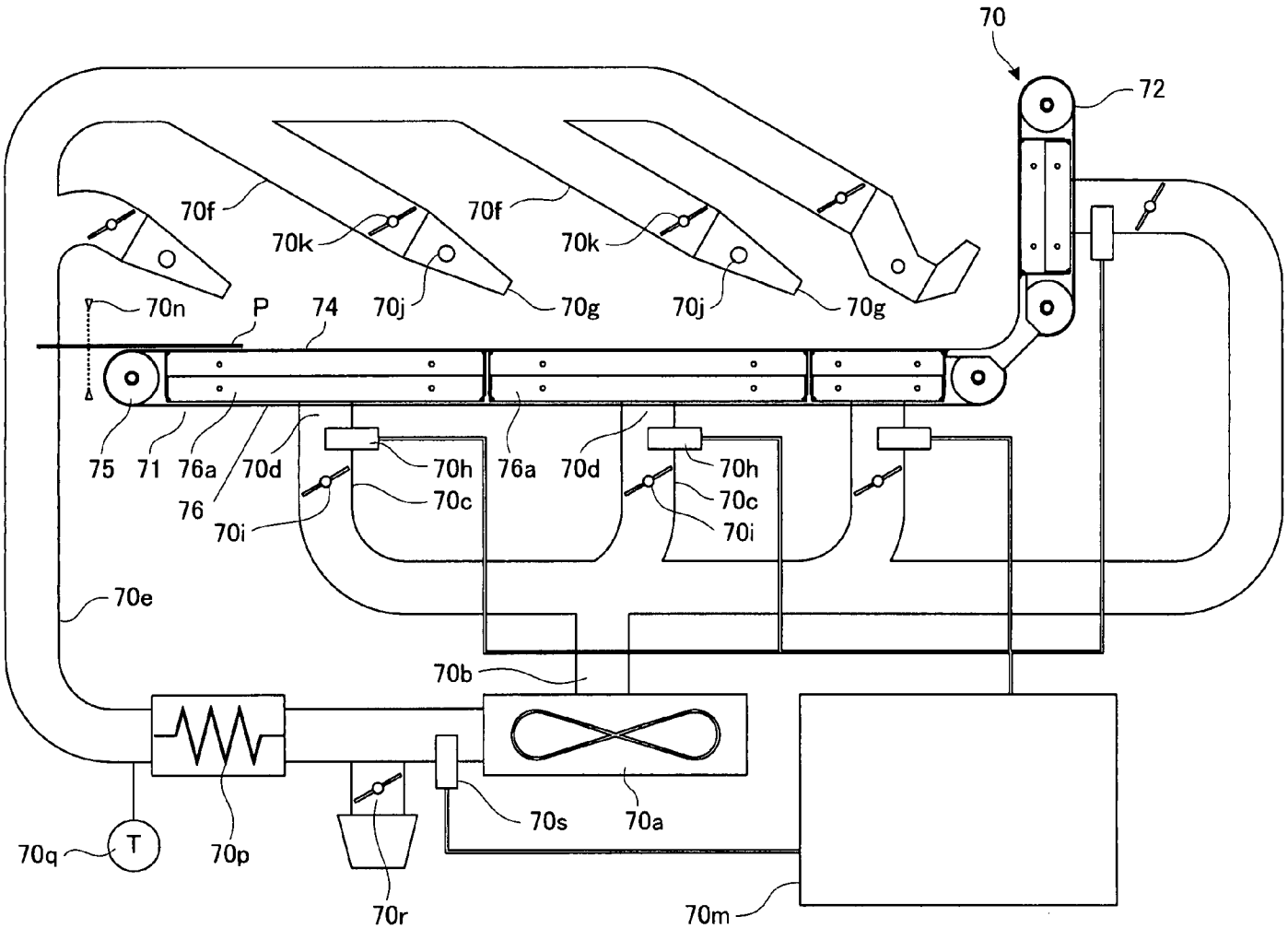
FIG. 8 is a schematic diagram showing the configuration of a suction device according to the embodiment.

As shown in FIG. 8, the first transport apparatus 71 and the second transport apparatus 72 include suction machines 76 acting as suction devices. In the first transport apparatus 71, a plurality of suction boxes 76*a* of the suction machine 76 are disposed along the sheet transport direction. In the second transport apparatus 72, a single suction box 76*a* is disposed. The suction machine 76 of the second transport apparatus 72 may include a plurality of suction boxes 76*a*.

The transport tracks are formed on the suction boxes 76*a* of the suction machines 76, and the suction boxes 76*a* each communicate with an air suction source, in this case, a suction fan device 70*a* through an inlet pipe 70*b*.

The inlet pipe 70*b* has one end communicating with the suction side of the suction fan device 70*a* and the other end branched into a plurality of branch pipes 70*c*. The branch pipes 70*c* each have an air inlet 70*d* communicating with the suction box 76*a*. An exhaust pipe 70*e* has one end communicating with the exhaust side of the suction fan device 70*a* and the other end branched into a plurality of branch pipes 70*f*. Air exhaust nozzles 70*g* on the other ends of the branch pipes 70*f* are opened above the suction boxes 76*a*.

The inlet pipe 70*b* has a conduit from the suction side of the suction fan device 70*a* to a branch point with an internal diameter larger than the internal diameter of the branch pipe 70*c* branched from the branch point. The exhaust pipe 70*e* has a conduit from the exhaust side of the suction fan device 70*a* to a branch point with an internal diameter larger than the internal diameter of the branch pipe 70*f* branched from the branch point.

The air exhaust nozzles 70*g* of the exhaust pipe 70*e* are opened in the sheet transport direction. Air is jetted from the air exhaust nozzles 70*g* downstream along the sheet transport direction and the air is jetted onto a sheet P having been sucked on the transport belts 74.

Near the air inlets 70*d* of the inlet pipe 70*b*, provided are air pressure detection sensors 70*h* and air intake amount adjusting valves 70*i* driven by motors (including a gear motor, a stepping motor, and a servo motor). Near the air exhaust nozzles 70*g* of the exhaust pipe 70*e*, provided are air flow rate detection sensors 70*j* and air exhaust amount adjusting valves 70*k* driven by motors (including a gear motor, a stepping motor, and a servo motor). A controller 70*m* controls the openings of the air intake amount adjusting valves 70*i* corresponding to the air pressure detection sensors 70*h*, according to the detected values of the air pressure detection sensors 70*h*, and the controller 70*m* controls the openings of the air exhaust amount adjusting valves 70*k* corresponding to the air flow rate detection sensors 70*j*, according to the detected values of the air flow rate detection sensors 70*j*.

On the transport start end of the first transport apparatus 71, a sensor 70*n* is disposed as a sensor device for detecting the transport position of a sheet. After the sensor 70*n* detects the passage of the sheet P, the current transport position of the sheet in the first transport apparatus 71 and the second transport apparatus 72 is calculated by counting the number of steps of an encoder mounted in the driving motor of the belt rollers 75. The controller 70*m* adjusts at least one of air intake timing for sucking air from openings 76*c* of the suction boxes 76*a* according to the current transport position of the sheet and air intake and exhaust timing for jetting air from the air exhaust nozzles 70*g* corresponding to the sheet P on the transport belts 74. In the present embodiment, the air intake timing and the air intake and exhaust timing are both adjusted.

The conduit of the exhaust pipe 70*e* has a heating wire 70*p* as a heating device upstream from the branch point and has a temperature sensor 70*q* downstream from the heating wire 70*p*. An external exhaust valve 70*r* is disposed so as to communicate with the conduit upstream from the branch point of the exhaust pipe 70*e* and to be driven by a motor (including a gear motor, a stepping motor, and a servo motor) and an air pressure detection sensor 70*s* is provided in the conduit upstream from the external exhaust valve 70*r*.

The controller 70*m* controls the suction forces of the suction machines 76 of the first transport apparatus 71 and the second transport apparatus 72 and controls the suction fan device 70*a* according to at least one of the kind (size, thickness, and so on) and the transport speed of the sheet P (the traveling speed of the transport belt) as sheet transport conditions, so that the suction forces of the suction machines 76 are controlled.

Figure 10:
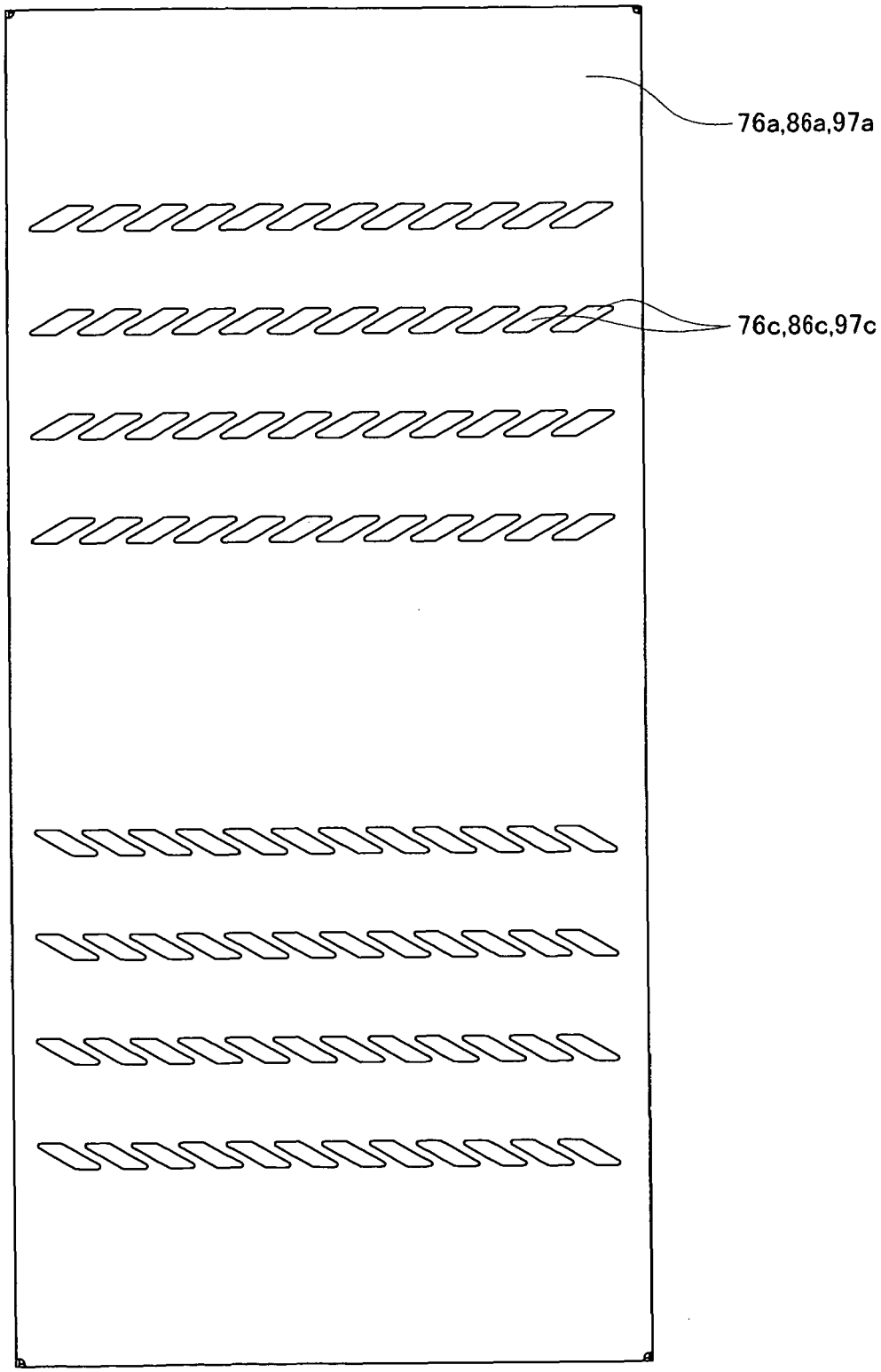
FIG. 10 is a schematic diagram showing the detail of transport apparatuses according to the embodiment of the present invention.
Figure 18:
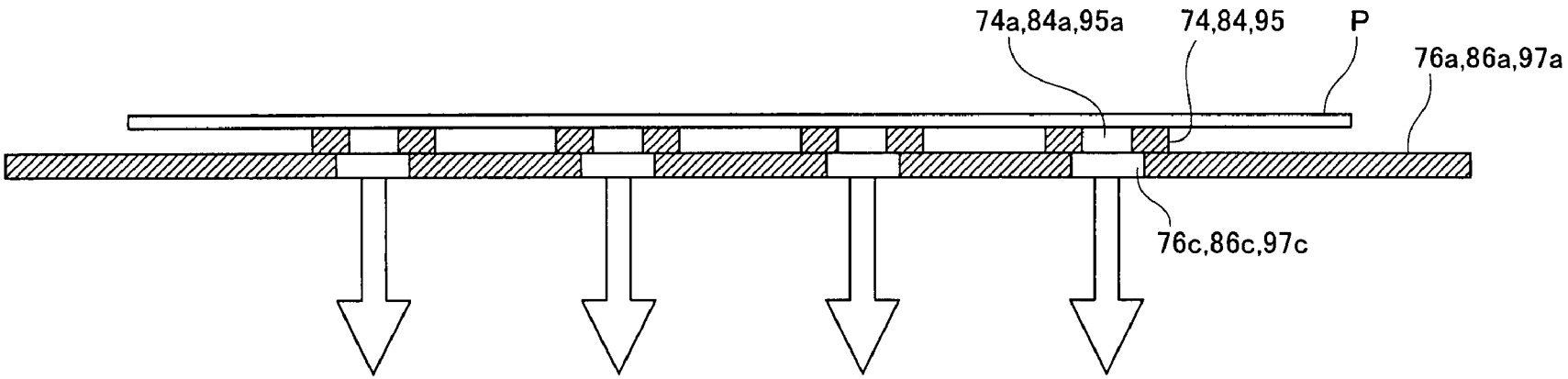
FIG. 18 is a sectional view showing a transport state of each transport apparatus according to the embodiment of the present invention.

As shown in FIGS. 10 and 18, the suction box 76*a* has the plurality of openings 76*c* under the transport tracks of the transport belts 74 and composes a suction air flow path from the openings 76*c* to the suction fan device 70*a*. The suction machine 76 sucks the sheet P on the transport belts through suction holes 74*a* formed on the transport belts 74.

Figure 6:
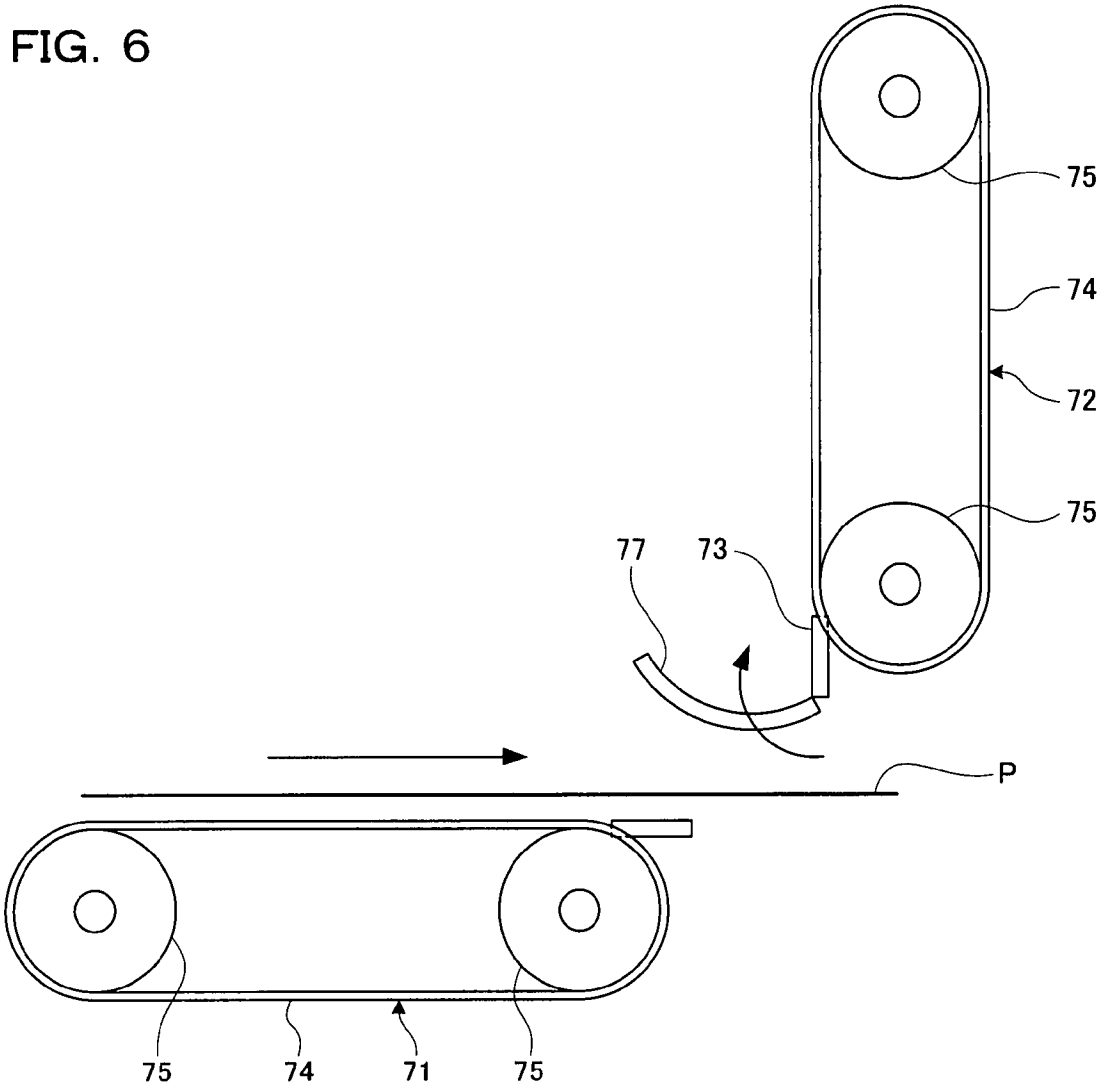
FIG. 6 is a side view showing the ejection mode of a turn guide in the first sheet inverting apparatus according to the embodiment.
Figure 7:
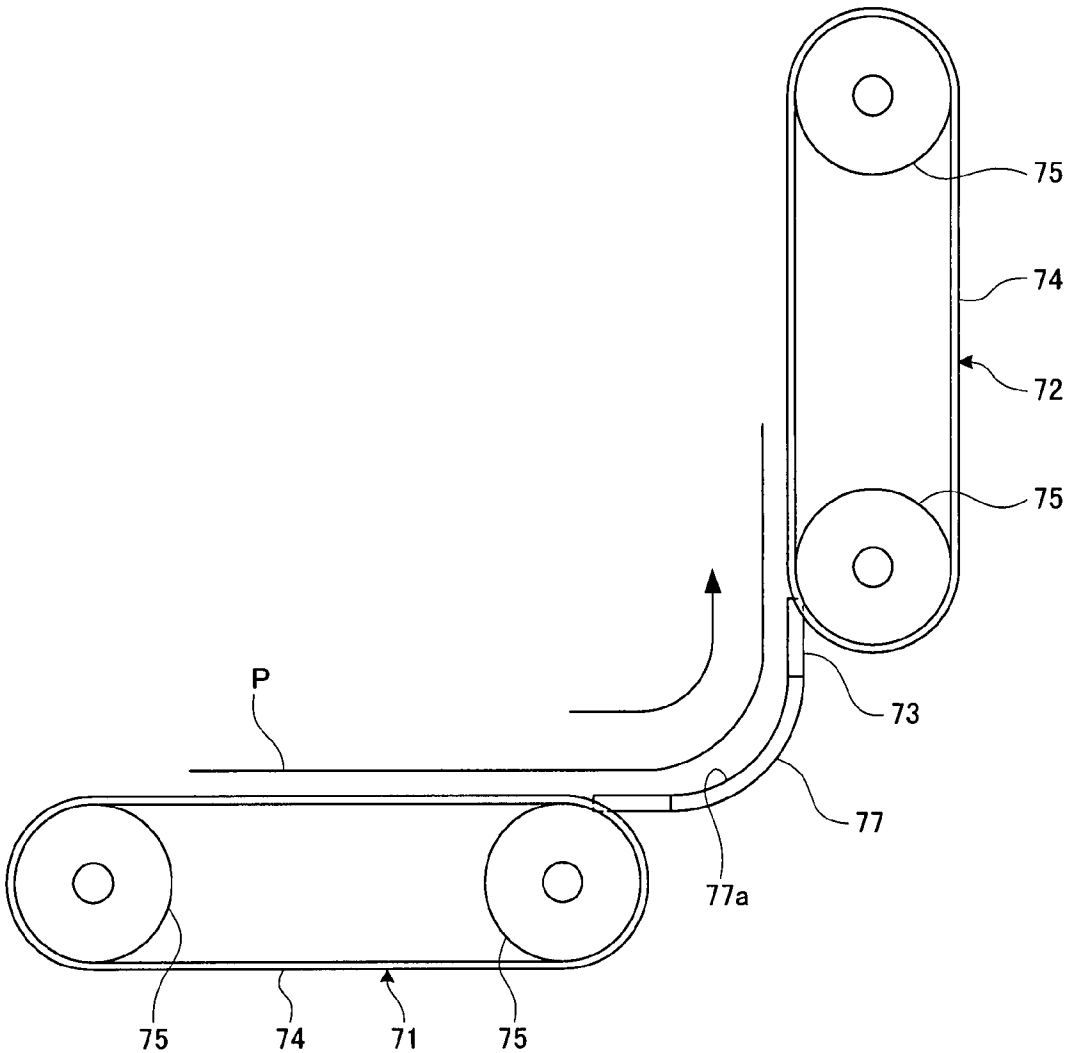
FIG. 7 is a side view showing the inversion mode of the turn guide in the first sheet inverting apparatus according to the embodiment.

The turn guide 73 has a plurality of guide ribs 77 which are arranged along the inversion axis with a 20-mm to 50-mm pitch and are interposed between the transport belts 74. The guide ribs 77 which are in slidable contact with the sheet P have slidable contact portions forming curved inverting transfer surfaces 77*a* from an inversion starting point side corresponding to the first transport surface to an inversion end point side corresponding to the second transport surface. As shown in FIGS. 6 and 7, the guide ribs 77 can swing between a state in which the first transport surface and the second transport surface are connected to each other and a state in which the first transport surface and the second transport surface are separated from each other.

Figure 3:
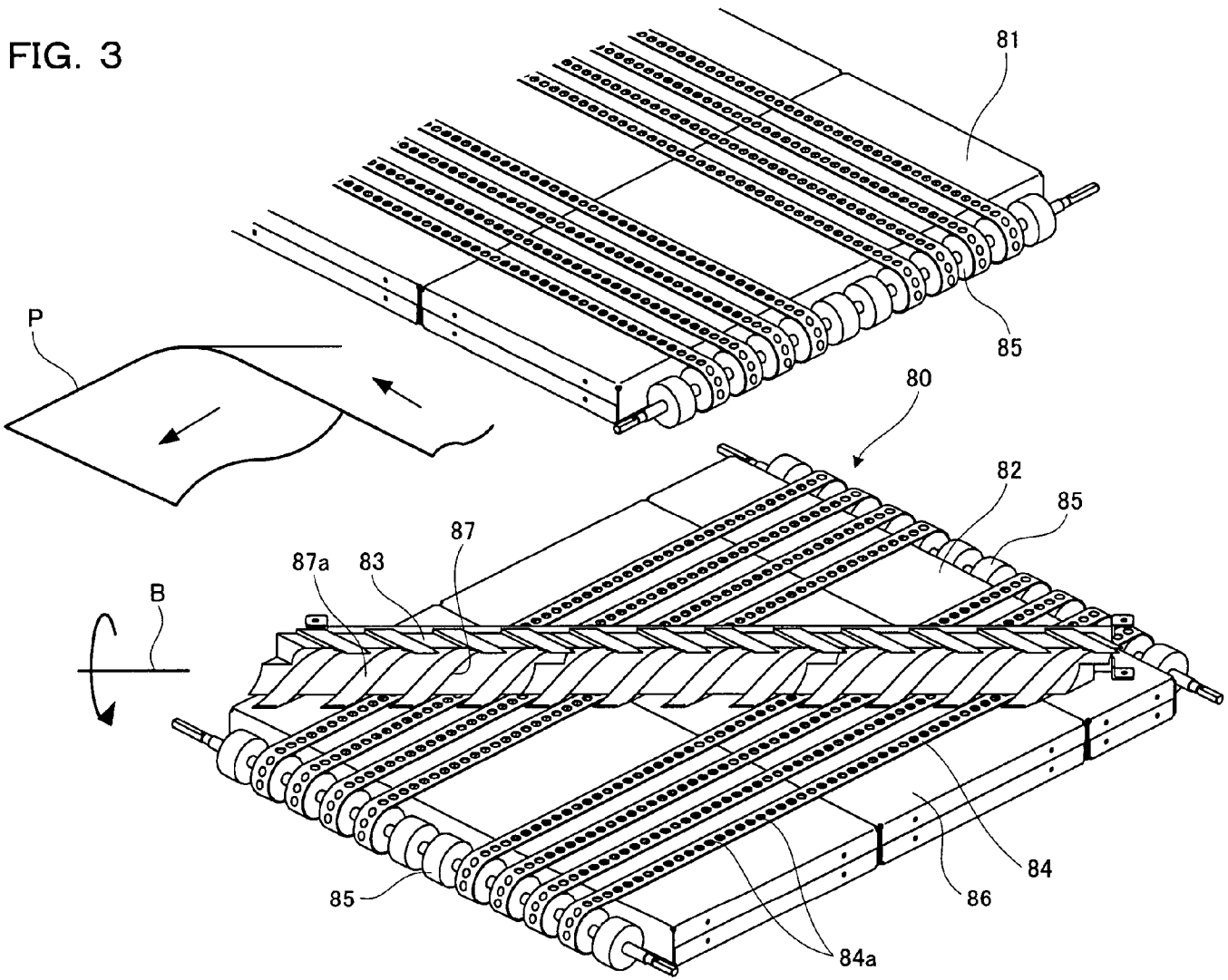
FIG. 3 is a perspective view showing a second sheet inverting apparatus according to the embodiment.

As shown in FIG. 3, the second sheet inverting apparatus 80 includes a first transport apparatus 81 forming a first transport surface (face down) on which a sheet of paper is transported in the horizontal direction, a second transport apparatus 82 forming a second transport surface (face up) which is opposed to the first transport surface and has a sheet transported in the horizontal direction, and a turn guide 83 which inverts the sheet P about an inversion axis B by a predetermined inversion angle, in this case, by 180° when the sheet P is transferred from the first transport surface to the second transport surface, and changes the transport direction of the sheet by a predetermined turning angle, in this case, by 90°.

The upper first transport apparatus 81 and the lower second transport apparatus 82 are disposed at relative positions where the sheet transport directions are orthogonal to each other. At the relative positions, the inversion axis B of the sheet P is tilted by 45° relative to a direction orthogonal to the sheet transport directions. The turn guide 83 is in parallel with the inversion axis B.

The first transport apparatus 81 and the second transport apparatus 82 include a plurality of transport belts 84 moving on transport tracks along the sheet transport directions. The transport belts 84 are each made up of an endless belt looped over belt rollers 85 disposed on both ends of the transport track.

The transport tracks are formed on suction boxes 86*a* of a plurality of suction machines 86 acting as suction devices. As shown in FIG. 18, the suction box 86*a* has a plurality of openings 86*c* under the transport track. The sheet P is sucked on the transport belts through suction holes 84*a* formed on the transport belts 84.

The turn guide 83 has a plurality of guide ribs 87 which are arranged with a predetermined pitch along the inversion axis B, have a center distance of 20 mm to 50 mm in a direction orthogonal to the sheet transport direction, and are interposed between the transport belts 84. The guide ribs 87 which are in slidable contact with the sheet P have slidable contact portions forming curved inverting transfer surfaces 87*a* from an inversion starting point side corresponding to the first transport surface to an inversion end point side corresponding to the second transport surface. On the inversion starting point side, the inverting transfer surfaces 87*a* are directed in the sheet transport direction of the first transport apparatus 81. On the inversion end point side, the inverting transfer surfaces 87*a* are directed in the sheet transport direction of the second transport apparatus 82. Thus the inverting transfer surfaces 87*a* are twisted by 90° between the inversion starting point side and the inversion end point side (see FIGS. 4 and 5).

The third sheet inverting apparatus 90 is configured as the first sheet inverting apparatus 70. One end of the third sheet inverting apparatus 90 is connected to the second transport apparatus 82 of the second sheet inverting apparatus 80 of the upper inverting transfer unit 6 and the other end of the third sheet inverting apparatus 90 is connected to the first transport apparatus 71 of the first sheet inverting apparatus 70 of the lower inverting transfer unit 6.

In the present embodiment, the third sheet inverting apparatus 90 includes a first transport apparatus 91 forming a first transport surface on which a sheet is transported in the vertical direction, a second transport apparatus 92 forming a second transport surface on which a sheet is transported in the horizontal direction, a third transport apparatus 93 forming a third transport surface on which a sheet is transported in the vertical direction, and a turn guide 94 which inverts a sheet of paper about an inversion axis by a predetermined inversion angle, in this case, by 90°. The first transport apparatus 91 is connected to the upper inverting transfer unit 6 and the third transport apparatus 93 is connected to the lower inverting transfer unit 6.

The first transport apparatus 91, the second transport apparatus 92, and the third transport apparatus 93 include a plurality of transport belts 95 moving on transport tracks along the paper transport directions. The transport belts 95 are each made up of an endless belt looped over belt rollers 96 disposed on both ends of the transport track.

The transport track is formed on suction boxes 97*a* acting as suction devices. The suction boxes 97*a* each communicate with an air suction source (not shown). As shown in FIG. 10, the suction box 97*a* has a plurality of openings 97*c* under the transport track. As shown in FIG. 18, the sheet P is sucked on the transport belts through suction holes 95*a* formed on the transport belts 95.

The turn guide 94 is identical to the turn guide 73 of the first sheet inverting apparatus 70 and thus the explanation thereof is omitted.

Figure 21A:
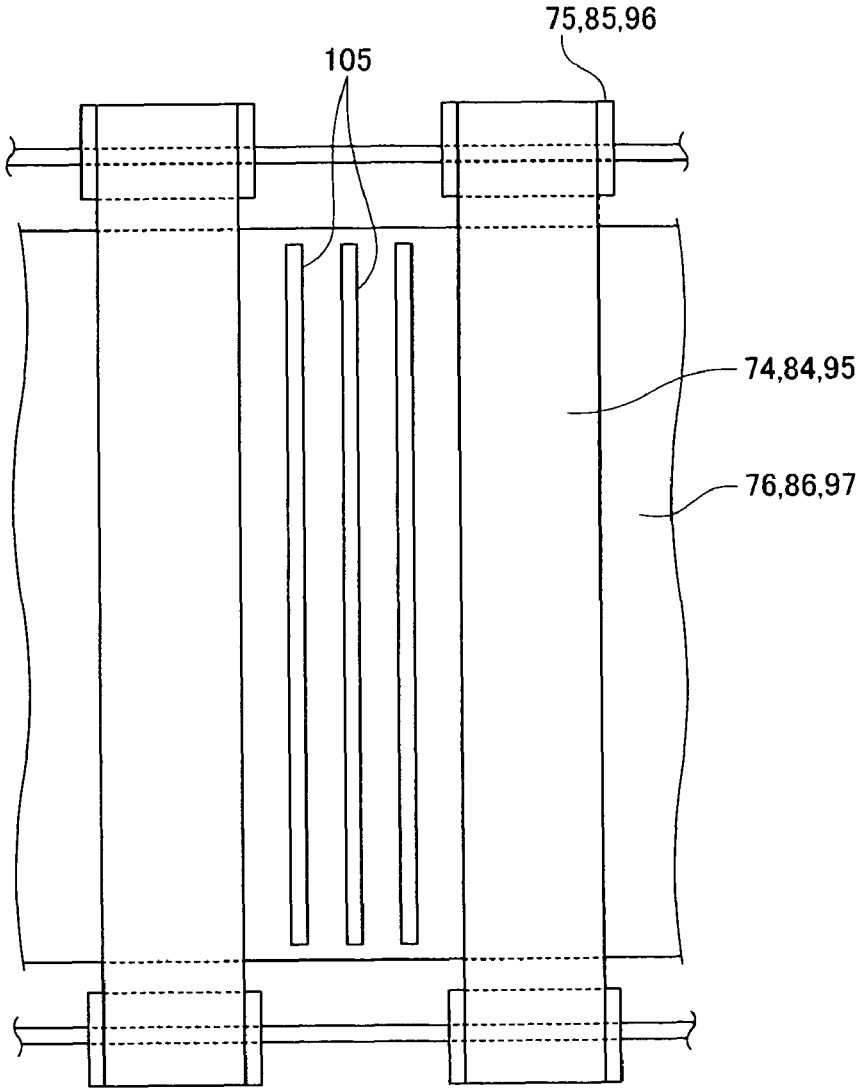
FIG. 21 is a schematic view showing the detail of each transport apparatus according to the embodiment of the present invention.
Figure 21B:
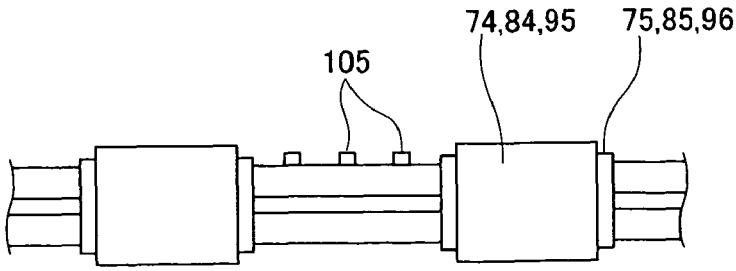

As shown in FIG. 20(*a*), the transport apparatuses 71, 72, 81, 82, 91, 92 and 93 may include a plurality of protrusions 101 formed as low-friction members on portions where the transport belts 74, 84 and 95 slide. Alternatively, a low-friction member 102 may be provided as shown in FIG. 20(*b*). As shown in FIG. 20(*c*), the transport belts 74, 84 and 95 have a plurality of protrusions 103 formed on the surfaces coming into contact with a sheet of paper. As shown in FIG. 20(*d*), the belt rollers 75, 85 and 96 for driving the transport belts 74, 84 and 95 have a plurality of protrusions 104 formed on portions pressed to the transport belts. As shown in FIGS. 21(*a*) and 21(*b*), the transport apparatuses 71, 72, 81, 82, 91, 92 and 93 include a plurality of ribs 105 acting as sheet support members between the transport belts 74, 84 and 95.

The ribs 105 are as high as or lower than the surfaces of the transport belts on the transport track. On a position corresponding to the inversion starting point side of the turn guide, the ribs 105 are higher than the inverting transfer surfaces. On a position corresponding to the inversion end point side of the turn guide, the ribs 105 are lower than the inverting transfer surfaces. The corners of the top surfaces of the ribs coming into contact with a sheet of paper are disposed along the sheet transport direction and the corners are preferably curved to prevent a scratch on the sheet.

The operation of the aforementioned configuration will be described below. The sheet P having one side printed by the printer body 3 enters the upper inverting transfer unit 6 of the sheet inverting mechanism 4 and reaches the start end side of the first transport apparatus 71 of the first sheet inverting apparatus 70.

At this point, the sensor 70*n* detects the passage of the sheet P and then the number of steps of the encoder mounted in the driving motor of the belt roller 75 is counted, so that the current transport position of the sheet is calculated. The transport position of the sheet P is continuously monitored in the first transport apparatus 71 and the second transport apparatus 72.

As shown in FIG. 18, the first transport apparatus 71 sucks on the transport belts the opposite side of the sheet P from the printed surface through the suction holes 74*a* formed on the transport belts 74, by means of the suction boxes 76*a*. In this state, the transport belts 74 move with the sheet on the transport track, so that the sheet P is transported in the sheet transport direction on the first transport surface.

At this point, the controller 70*m* controls the suction fan device 70*a* according to the sheet transport conditions, for example, the kind (size, thickness, and so on) of sheet or the transport speed of the transport device to adjust the suction force of the suction fan apparatus 70*a* and air in the suction boxes 76*a* of the first transport apparatus 71 and the second transport apparatus 72 can be sucked and exhausted by the single suction fan device 70*a*. In other words, air sucked from the suction boxes 76*a* to the branch pipes 70*c* of the inlet pipe 70*b* through the air inlets 70*d* reaches the suction fan device 70*a* and the air is jetted to the sheet P from the air exhaust nozzles 70*g* through the branch pipes 70*f* of the exhaust pipe 70*e*.

The controller 70*m* controls the openings of the air intake amount adjusting valves 70*i* corresponding to the air pressure detection sensors 70*h*, according to air pressures detected by the air pressure detection sensors 70*h*. This control stabilizes a suction force applied to the sheet P. Further, the controller 70*m* controls the openings of the air exhaust amount adjusting valves 70*k* corresponding to the air flow rate detection sensors 70*j*, according to air flow rates detected by the air flow rate detection sensors 70*j*. This control stabilizes the amounts of air jetted from the air exhaust nozzles 70*g* of the branch pipes 70*f*, achieving stable air intake and exhaust. In this operation, an amount of air sucked from the suction box 76*a* and an amount of air jetted from the air exhaust nozzle 70*g* of the exhaust pipe 70*e* on the current transport position of the sheet P are set larger as compared with the other suction boxes 76*a* and the other air exhaust nozzles 70*g*, so that the single suction fan device 70*a* can achieve stable air intake and exhaust in the suction boxes 76*a* of the first transport apparatus 71 and the second transport apparatus 72.

Moreover, air jetted from the air exhaust nozzles 70*g* of the exhaust pipe 70*e* toward the sheet P on the transport belts 74 can prevent the end of the sheet from being lifted. With air jetted from the air exhaust nozzles 70*g*, air heated by the heating wire 70*p* is jetted to the sheet P on the transport belts 74 from the air exhaust nozzles 70*g*, accelerating drying on the printed surface of the sheet P and the drying of ink. At this point, the heating of air with the heating wire 70*p* is controlled based on a temperature detected by the temperature sensor 70*q*.

In the case where air is just sucked from the air inlets 70*d*, the external exhaust valve 70*r* is opened to exhaust air to the outside, so that the sheet P on the transport belts 74 is just sucked. Alternatively, when the pressures of air jetted from the air exhaust nozzles 70*g* are reduced, the opening of the external exhaust valve 70*r* is adjusted to adjust the pressures of air jetted from the air exhaust nozzles 70*g* to the sheet P on the transport belts 74.

Figure 9:
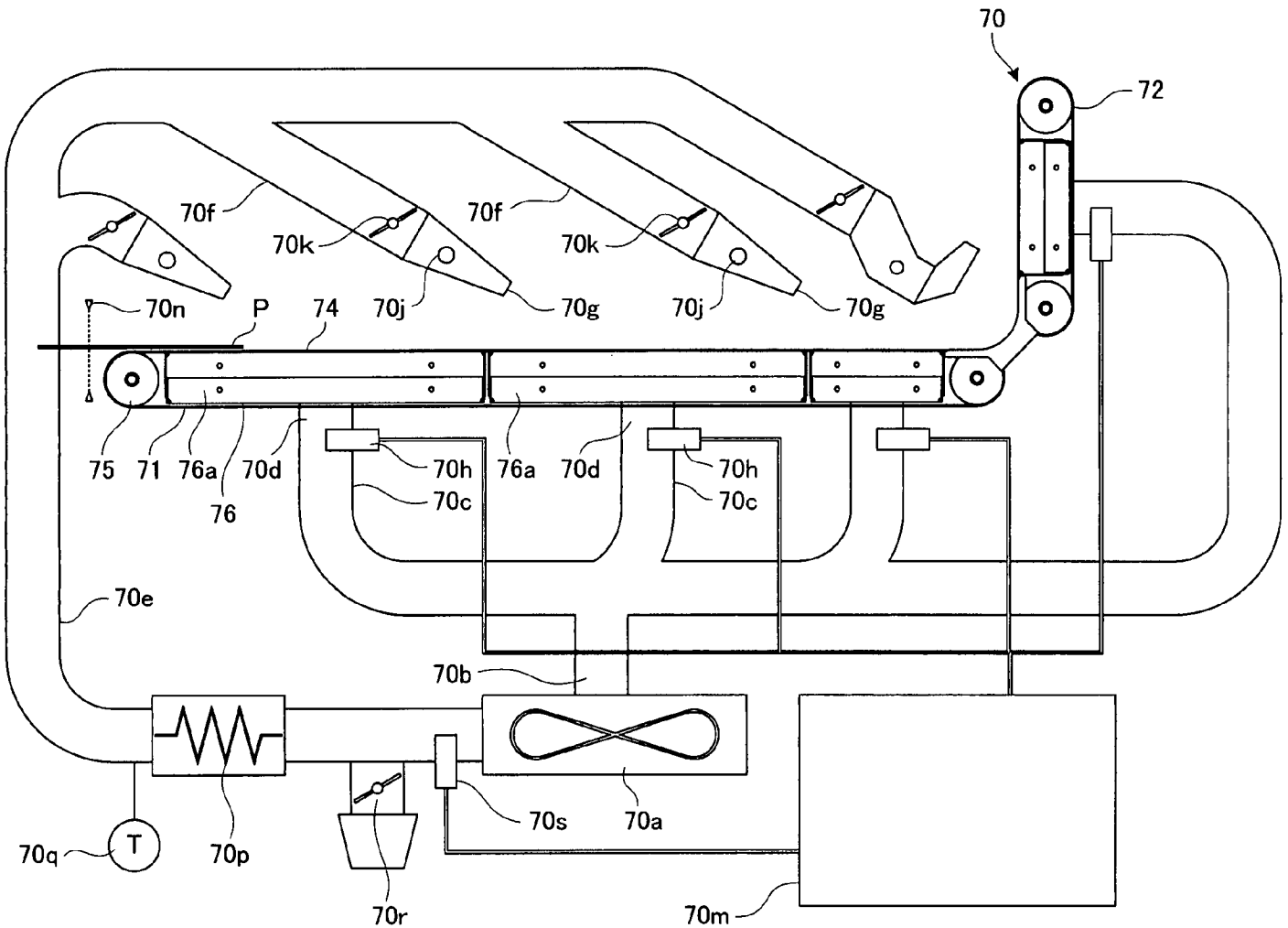
FIG. 9 is a schematic diagram showing the configuration of a suction device according to another embodiment.

In the configuration of FIG. 8, the openings of the air intake amount adjusting valves 70*i* are controlled according to air pressures detected by the air pressure detection sensors 70*h*. As shown in FIG. 9, the foregoing operation can be achieved also by adjusting only the openings of the air exhaust amount adjusting valves 70*k* and the external exhaust valve 70*r* without providing the air intake amount adjusting valves 70*i*.

Next, when the sheet P is ejected to the sheet receiving unit 7 through the sheet inverting mechanism 4 in the shortest time, as shown in FIG. 6, the guide ribs 77 of the turn guide 73 are operated so as to separate the first transport surface and the second transport surface, and then the sheet P is ejected from the first transport apparatus 71 to the sheet receiving unit 7.

After printed in the printer body 3, when the sheet P has to be kept in the sheet inverting mechanism 4 for a longer time to dry the printed surface of the sheet, as shown in FIG. 7, the guide ribs 77 of the turn guide 73 are operated so as to connect the first transport surface and the second transport surface.

This configuration can be provided at a certain point of the third transport apparatus 93 to switch, when a mechanism is provided to return the sheet to the printer body 3, a state in which the sheet is introduced into the mechanism and a state in which the sheet is not introduced into the mechanism.

As shown in FIG. 2, the first transport apparatus 71 transports the sheet P in the sheet transport direction on the first transport surface, the sheet P reaches the turn guide 73, and then the end of the sheet enters the inverting transfer surfaces 77*a* from the inversion starting point side of the turn guide 73.

Next, as the sheet P moves in the sheet transport direction, the guide ribs 77 guide the end of the sheet with the inverting transfer surfaces 77*a*, the back side of the sheet P comes into slidable contact with the inverting transfer surfaces 77*a*, and the surfaces of the sheet P are inverted and curved along the inverting transfer surfaces 77*a*, following the end of the sheet. In this case, the sheet P is inverted by 90°.

The sheet P reaches the second transport apparatus 72 and one end of the sheet enters the second transport surface from the inversion end point sides of the inverting transfer surfaces 77*a* of the guide ribs 77 of the turn guide 73. The transport belts 74 move with the sheet P on the transport track, so that the sheet P is transported in the sheet transport direction on the second transport surface.

When the sheet P reaches the terminal end of the second transport apparatus 72, one end of the sheet enters a turn guide (identical to the turn guide 73 and not shown in FIG. 2), is inverted by 90° as in the foregoing operation, and enters the second sheet inverting apparatus 80.

As shown in FIG. 3, in the second sheet inverting apparatus 80, the first transport apparatus 81 sucks the opposite side of the sheet P from the printed surface through the suction holes 84*a* formed on the transport belts 84, on the transport belts by means of the suction box 86. The transport belts 84 move with the sheet P on the transport track, so that the sheet P is transported in the sheet transport direction on the first transport surface.

When the sheet P reaches the turn guide 83 and one end of the sheet P enters the inverting transfer surfaces 87*a* from the inversion starting point side of the turn guide 83, the guide ribs 87 guide the end of the sheet with the inverting transfer surfaces 87*a* as the sheet P moves in the sheet transport direction, the back side of the sheet P comes into slidable contact with the inverting transfer surfaces 87*a*, and the surfaces of the sheet P are inverted and curved along the inverting transfer surfaces 87*a*, following the end of the sheet. In this case, the sheet is inverted by 180°.

At this point, the upper first transport apparatus 81 and the lower second transport apparatus 82 are disposed at relative positions where the sheet transport directions are orthogonal to each other. The inversion axis B of the sheet P is tilted at the relative positions by 45° relative to a direction orthogonal to the paper transport direction and the turn guide 83 is disposed in parallel with the inversion axis B.

Therefore, an end corner on one side of the sheet P first reaches the turn guide 83 and then the end of the sheet enters the inverting transfer surfaces 87*a* from the end corner. The entry of the end of the sheet P to the inverting transfer surfaces 87*a* is delayed as being close to an end corner on the other side of the sheet P. The sheet P is first inverted from the end corner on the one side having first entered the inverting transfer surfaces 87*a* and the start of the inversion is delayed as being close to the end corner on the other side of the sheet P, so that the transport direction of the sheet P is changed.

In other words, when the sheet P is transferred from the first transport surface to the second transport surface, the turn guide 83 inverts the sheet P by the predetermined inversion angle about the inversion axis tilted by a predetermined angle of 45° relative to a direction orthogonal to the sheet transport direction of the first transport apparatus 81, so that the transport direction of the sheet P is changed by a predetermined turning angle of 90°.

Figure 4:
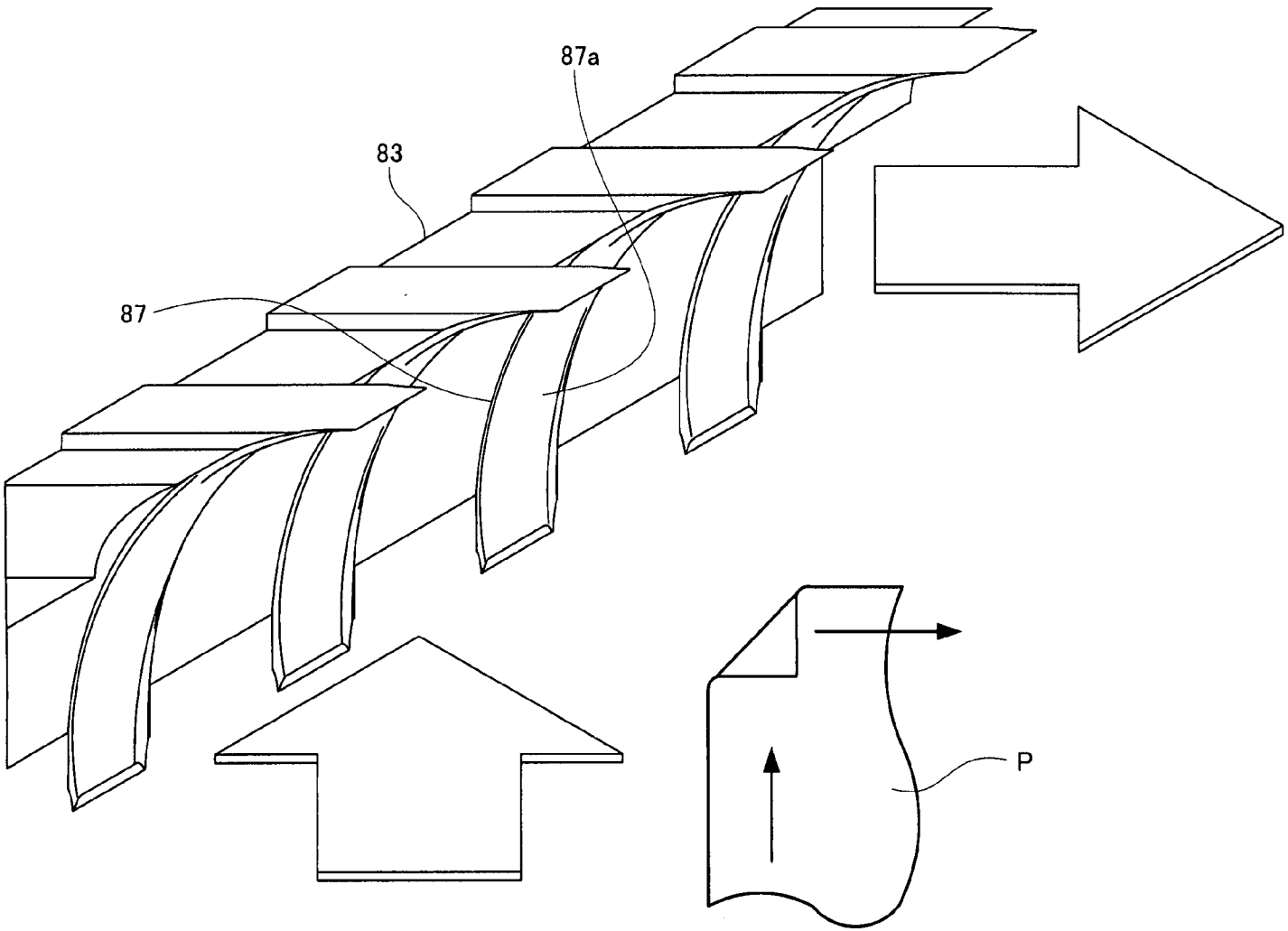
FIG. 4 is a perspective view showing a turn guide in the second sheet inverting apparatus according to the embodiment.
Figure 5:
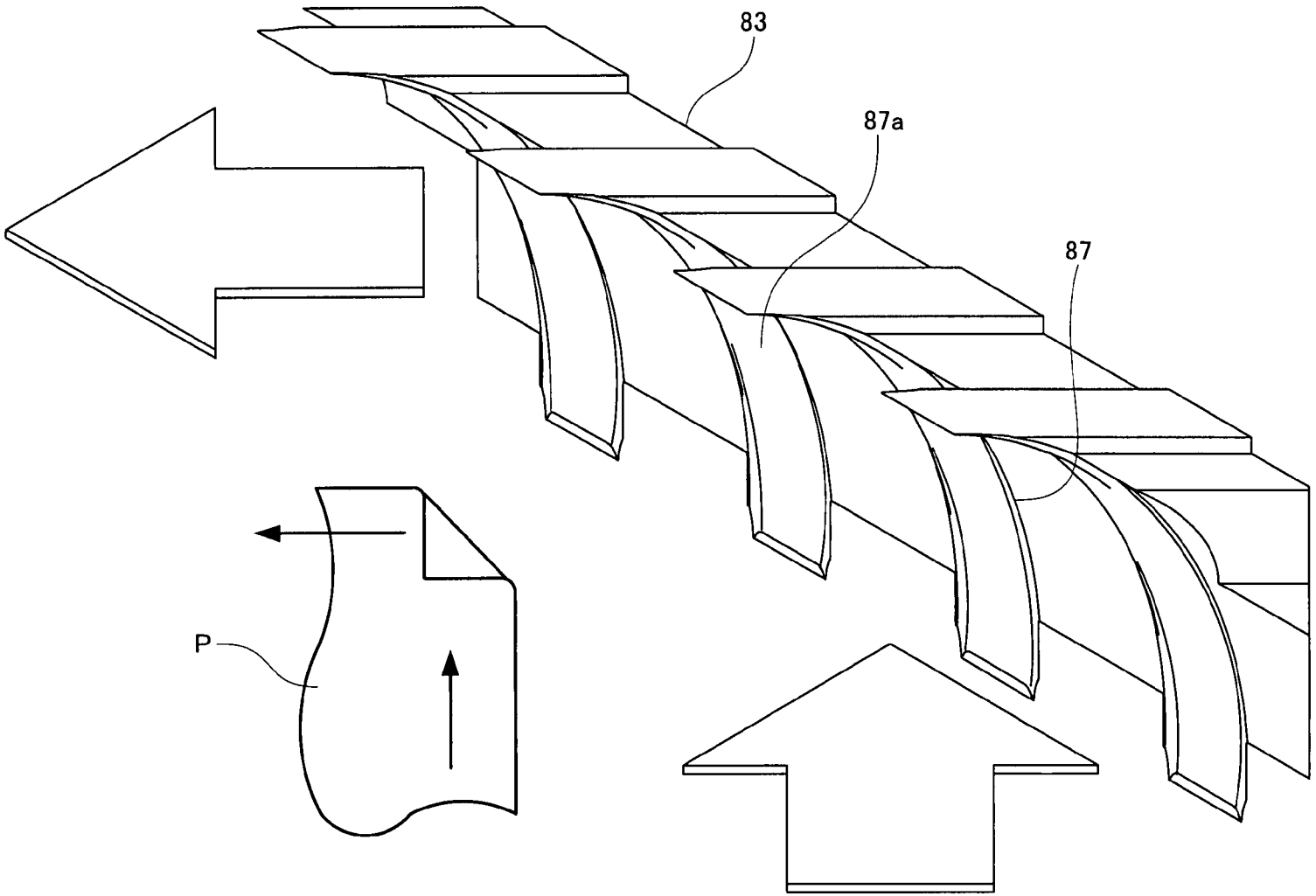
FIG. 5 is a perspective view showing another turn guide in the second sheet inverting apparatus according to the embodiment.

FIG. 4 shows the shape of the turn guide 83 when the sheet transport direction is changed to the right by 90° and is inverted by 180°. FIG. 5 shows the shape of the turn guide 83 when the sheet transport direction is changed to the left by 90° and is inverted by 180°.

When the sheet P reaches the second transport apparatus 82 and the end of the sheet enters the second transport surface from one end corner, the second transport apparatus 82 transports the sheet P in the sheet transport direction on the second transport surface. At this point, on the second transport surface, the sheet P returns to a position where the end is in parallel with a direction orthogonal to the sheet transport direction.

When the sheet P reaches the terminal end of the second transport apparatus 82, one end of the sheet enters a turn guide (identical to the turn guide 73 and not shown in FIG. 3), is inverted by 90° as in the foregoing operation, and enters the third sheet inverting apparatus 90.

The third sheet inverting apparatus 90 repeatedly inverts the sheets P by 90° while transporting the sheets P by the same operation as the first sheet inverting apparatus 70, and feeds the sheets P to the first transport apparatus 71 of the first sheet inverting apparatus 70 of the lower inverting transfer unit 6.

As has been discussed, the sheet P is inverted and the transport direction is changed in the upper inverting transfer unit 6 of the sheet inverting mechanism 4, the sheet P is transferred to the lower inverting transfer unit 6, and then the sheet P is inverted and the transport direction is changed in the lower inverting transfer unit 6 as in the upper inverting transfer unit 6. After that, the sheet P is ejected to the sheet receiving unit 7.

In the conduits of the branch pipes 70*c* shown in FIG. 9, members reducing the internal diameters of the branch pipes 70*c* are disposed and the openings 76*c*, 86*c*, and 97*c* of FIG. 10 are formed so as to have small areas.

With the foregoing configuration, an amount of air intake is limited so as to increase the resistance of air to be sucked, thereby keeping a negative pressure between air intake amount limiting members or the openings 76*c*, 86*c*, and 97*c* and the suction side of the suction fan device 70*a*. Thus it is possible to minimize fluctuations in suction force in the suction boxes 76*a*, 86*a*, and 97*a*. The suction forces in the suction boxes 76*a*, 86*a*, and 97*a* are changed by the passage of the sheet P moved by the transport belts 74, 84, and 95 on the transport tracks.

When paper powder from the transported sheet P falls between the transport belts 74, 84 and 95 and the sheet P sucked on the transport belts, the sheet P may slide. However, by collecting paper powder between the plurality of protrusions 103 provided on the transport belts 74, 84 and 95, it is possible to prevent the paper powder from falling between the transport belts 74, 84 and 95 and the sheet P, so that the sheet can be reliably transported.

Further, by engaging the rear end of the sheet onto the protrusions 103 of the transport belts 74, 84 and 95, the sheet P can be reliably pressed and transported.

Further, when paper powder falls between the transport belts 74, 84 and 95 and the belt rollers 75, 85 and 96, the transport belts 74, 84 and 95 may slide. However, by collecting paper powder between the plurality of protrusions 104 provided on the belt rollers 75, 85 and 96, it is possible to prevent the paper powder from falling between the belt rollers 75, 85 and 96 and the transport belts 74, 84 and 95, so that the transport belts 74, 84 and 95 can be reliably driven.

It is preferable that the protrusions 103 provided on the transport belts 74, 84 and 95 are 0.5 mm or less in height. When the heights of the protrusions exceed 0.5 mm, air leaks between the protrusions 103 and the suction force is reduced, so that the sheet P may not be sufficiently sucked.

Figure 19:
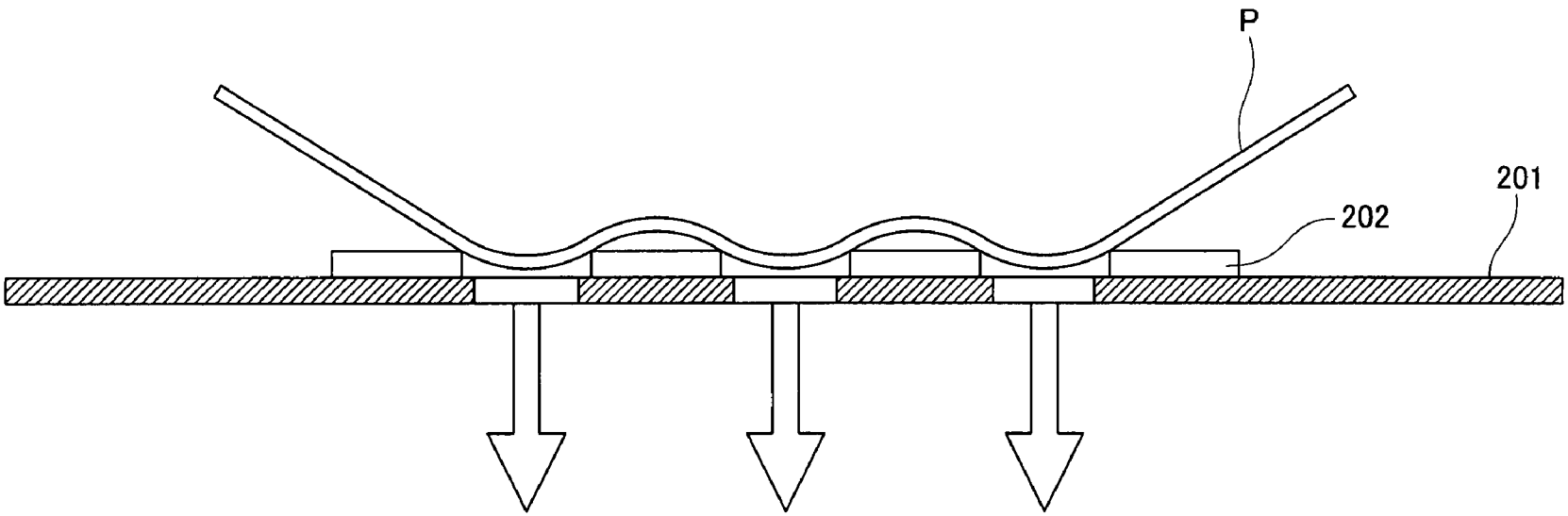
FIG. 19 PRIOR ART
FIG. 19 is a sectional view showing a transport state in a transport apparatus of the prior art.
Figure 20A:
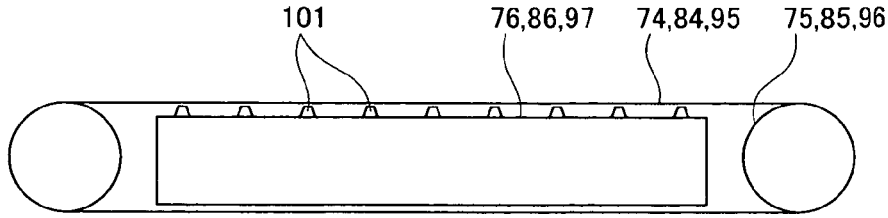
FIG. 20 is a schematic view showing the detail of each transport apparatus according to the embodiment of the present invention.
Figure 20B:
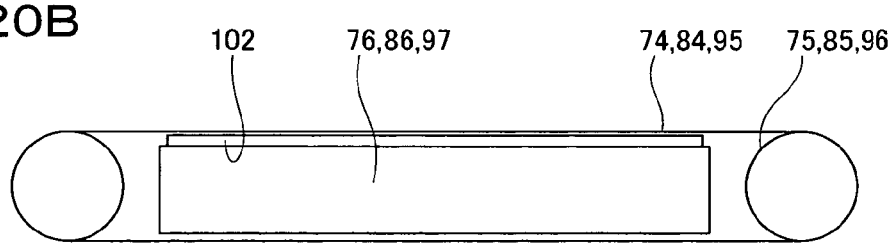
Figure 20C:
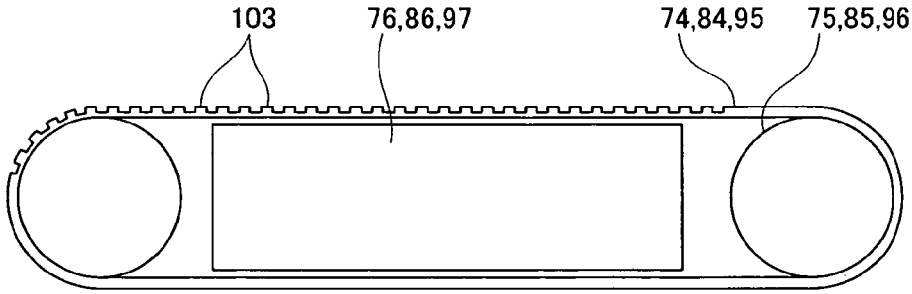
Figure 20D:
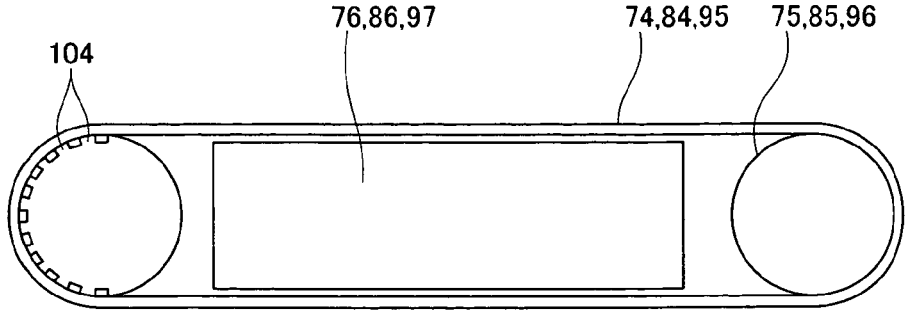

As shown in FIG. 19, in a configuration where a suction box 201 sucks the sheet P between transport belts 202, the sheet P enters between the transport belts 202 and dents are formed on the sheet P. On the reverse side of the sheet P, protrusions are formed between the transport belts 202 and the sheet P is wrinkled.

However, in the present embodiment, as shown in FIG. 18, the first transport apparatuses 71, 81 and 91 and the second transport apparatuses 72, 82 and 92 of the first to third sheet inverting apparatuses 70, 80 and 90 and the third transport apparatus 93 of the third sheet inverting apparatus 90 suck on the transport belts the opposite side of the sheet P from the printed surface through the suction holes 74*a*, 84*a* and 95*a* formed on the transport belts 74, 84 and 95, by means of the suction boxes 76*a*, 86*a* and 97*a*. The transport belts 74, 84 and 95 move with the sheet P on the transport tracks, so that the sheet P is transported in the sheet transport direction on the first transport surface. Thus it is possible to prevent a deformation of the sheet P. Further, the sheet P is supported by the ribs 105 between the transport belts to prevent a deformation of the sheet P, thereby preventing wrinkles when the sheet P is inverted.

Moreover, the diameters of the suction holes 74*a*, 84*a* and 95*a* are estimated at 5 mm or more to obtain a suction force allowing the transport belts 74, 84 and 95 to securely hold the sheet P on the suction holes 74*a*, 84*a* and 95*a*. When the suction holes 74*a*, 84*a* and 95*a* are formed at the centers of the transport belts 74, 84 and 95, it is preferable to leave at least a 5-mm width on each side of the suction holes 74*a*, 84*a* and 95*a* in consideration of the strengths of the belts. As a result, the belts have to be at least 15 mm in width. Moreover, the guide ribs have to be at least 2 mm in width in order to sufficiently hold the underside of the sheet.

As has been discussed, it is most preferable that the guide ribs have a center distance of 20 mm or more in a direction orthogonal to the sheet transport direction, in consideration of gaps between the guide ribs and the transport belts. When spacing between the guide ribs is too large, the end of the sheet is likely to be inserted between the guide ribs. Thus it is preferable to suppress the center distance between the guide ribs to 50 mm or less according to test results.

Figure 11:
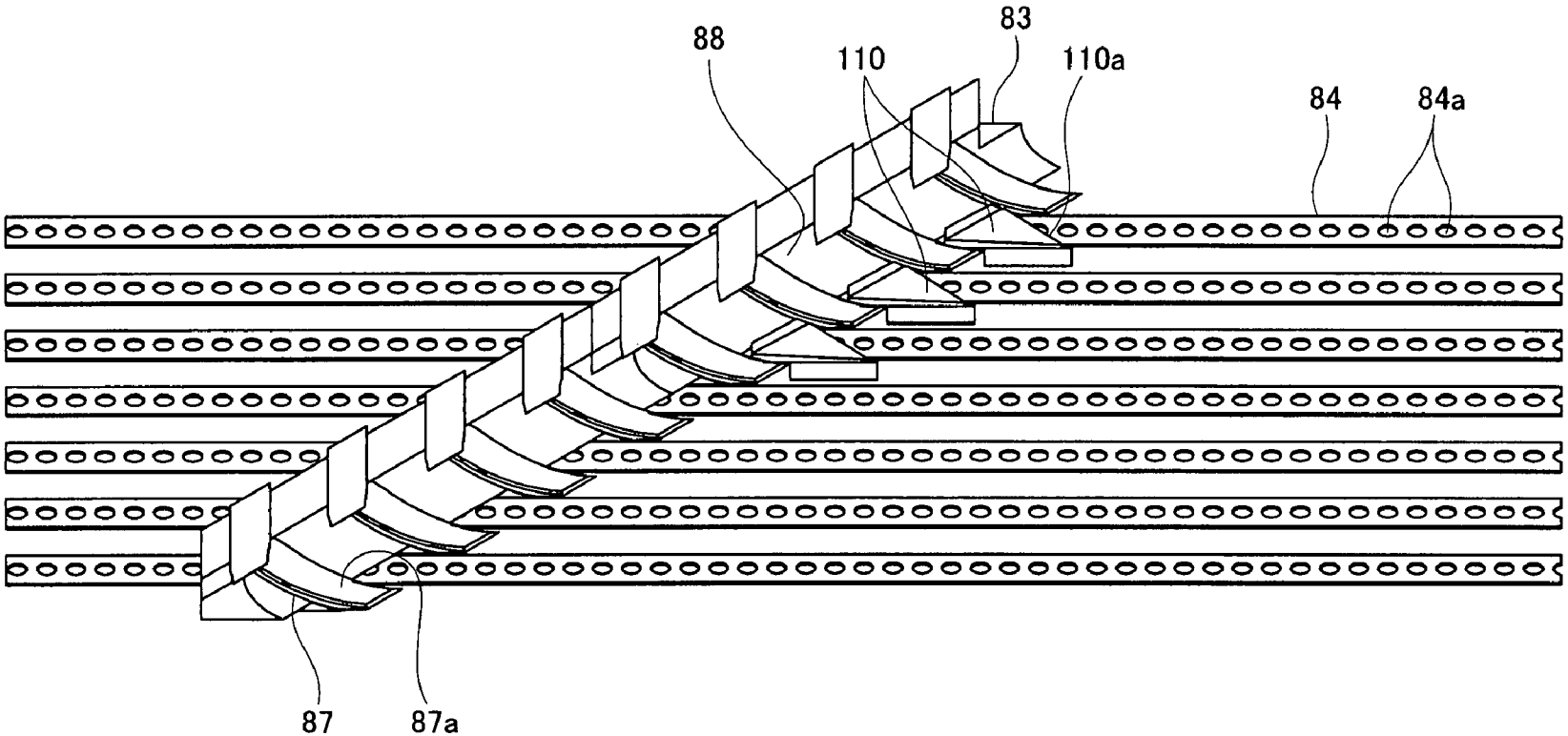
FIG. 11 is a perspective view showing a turn guide in a second sheet inverting apparatus according to another embodiment of the present invention.
Figure 12:
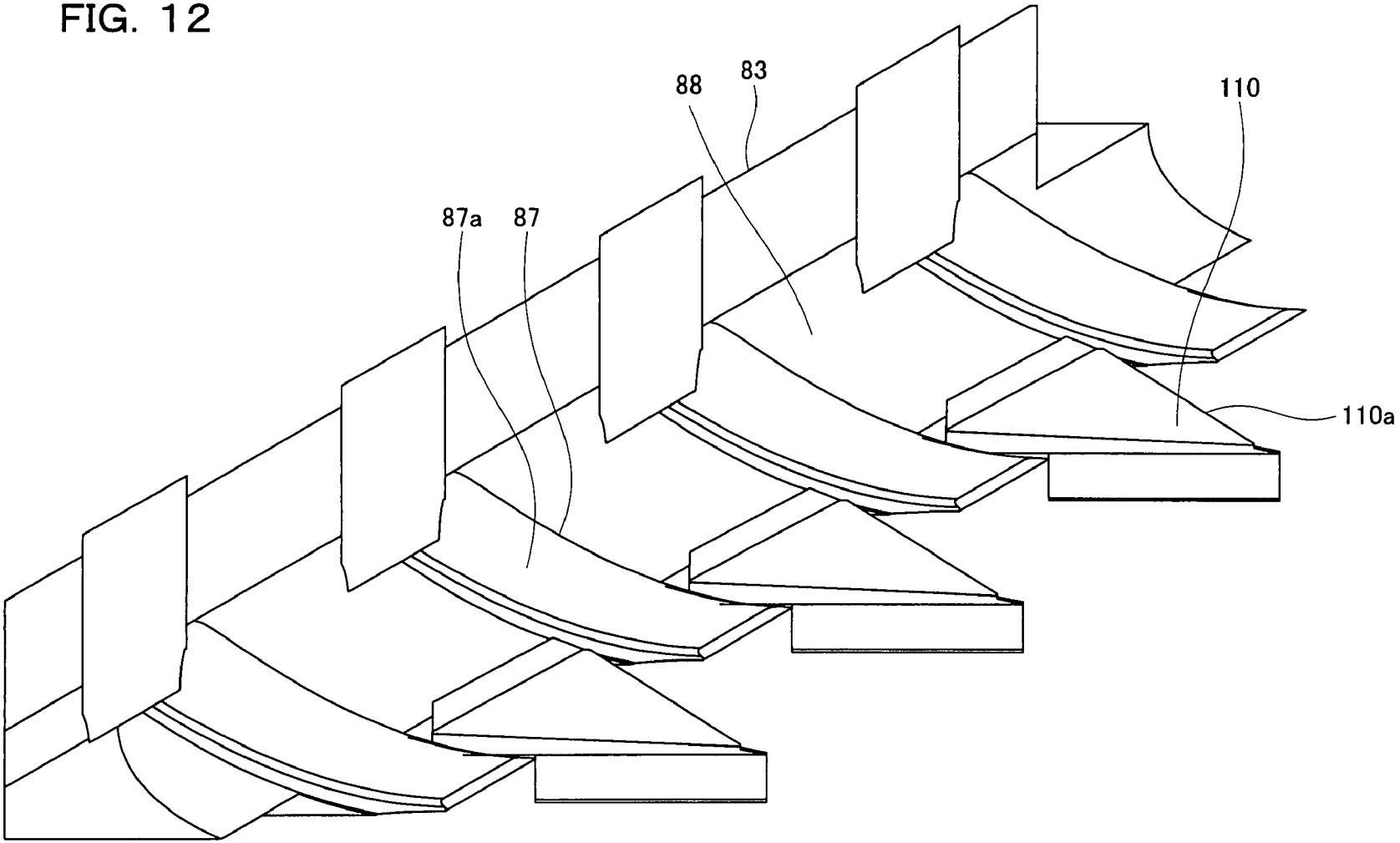
FIG. 12 is an enlarged perspective view showing the turn guide.
Figure 13:
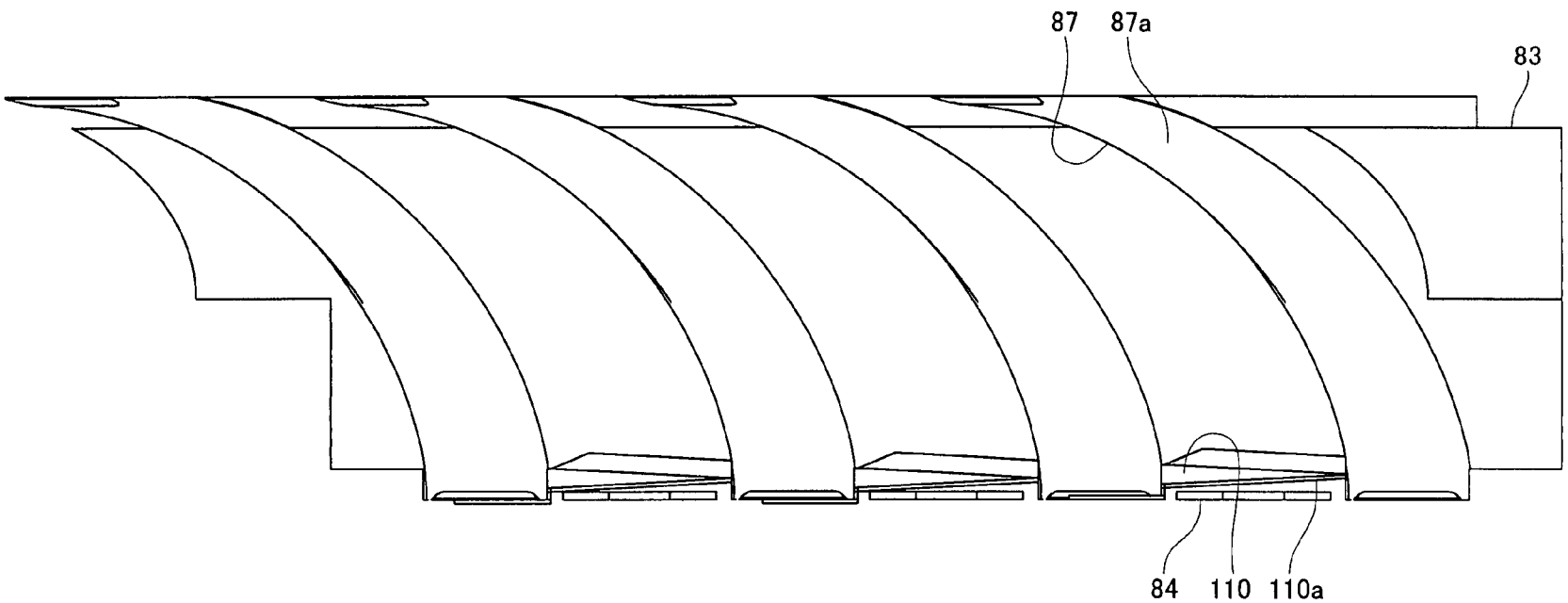
FIG. 13 is a front view showing the turn guide.

FIGS. 11 to 13 show another embodiment of the present invention. This embodiment is based on the configuration of the second sheet inverting apparatus 80 shown in FIG. 3. To be specific, an upper first transport apparatus 81 and a lower second transport apparatus 82 are disposed at relative positions where the sheet transport directions are orthogonal to each other. At the relative positions, an inversion axis B of a sheet P is tilted by 45° relative to a direction orthogonal to the sheet transport directions and a turn guide 83 is disposed in parallel with the inversion axis B.

Therefore, an end corner on one side of the sheet P first reaches the turn guide 83 and then the end of the sheet enters inverting transfer surfaces 87*a* from the end corner. The entry of the end of the sheet P to the inverting transfer surfaces 87*a* is delayed as being close to an end corner on the other side of the sheet P. The sheet P is first inverted from the end corner on the one side having first entered the inverting transfer surfaces 87*a* and the start of the inversion is delayed as being close to the end corner on the other side of the sheet P, so that the transport direction of the sheet P is changed.

The turn guide 83 has a plurality of escape portions 110 on an inversion starting point side corresponding to a first transport surface and between guide ribs corresponding to the end corner of the sheet. The escape portions 110 are disposed on positions first coming into contact with the sheets P of various sizes in the sheet transport direction.

The escape portions 110 are formed so as to be extended from a guide rib 87 disposed inside the end corner of the sheet to another guide rib 87 disposed outside the end corner of the sheet, and the escape portions 110 have escape portion front ends 110*a* which come into slidable contact with the end of the sheet and are formed so as to gradually retreat in the sheet transport direction as being close to the guide rib 87 disposed outside the end corner of the sheet. The escape portion front ends 110*a* have an elevation angle tilted by a predetermined angle relative to the first transport surface of the first transport apparatus 81. Further, the escape portion front ends 110*a* are tilted by a predetermined angle relative to a direction orthogonal to the transport direction in the first transport surface and are tilted by 30° to 60°.

In this configuration, the escape portions 110 have side edges which are in contact with the guide ribs 87 disposed inside the end corner of the sheet. The side edges are placed higher than the inverting transfer surfaces 87*a* of the guide ribs 87 disposed inside the end corner of the sheet and are formed along the transport belts 84. Further, the escape portion front ends 110*a* are positioned on guide surfaces 88 which are formed between the guide ribs 87 by the rear ends of the escape portions having retreated in the sheet transport direction. The escape portions 110 are preferably made up of flexible members separated from the turn guide 83.

With this configuration, when the sheet P is transferred from the first transport surface to a second transport surface, the sheet P is inverted by a predetermined inversion angle of 180° and the direction of the sheet P is changed by a predetermined turning angle of 90° by passage through the turn guide 83.

As the sheet moves in the sheet transport direction at this point, the guide ribs 87 guide the end of the sheet with the inverting transfer surfaces 87*a*, the sheet is first inverted from an end corner on one side having first entered the inverting transfer surfaces, and the surfaces of the sheet P are inverted and curved along the inverting transfer surfaces 87*a*, following the end of the sheet.

Figure 15:
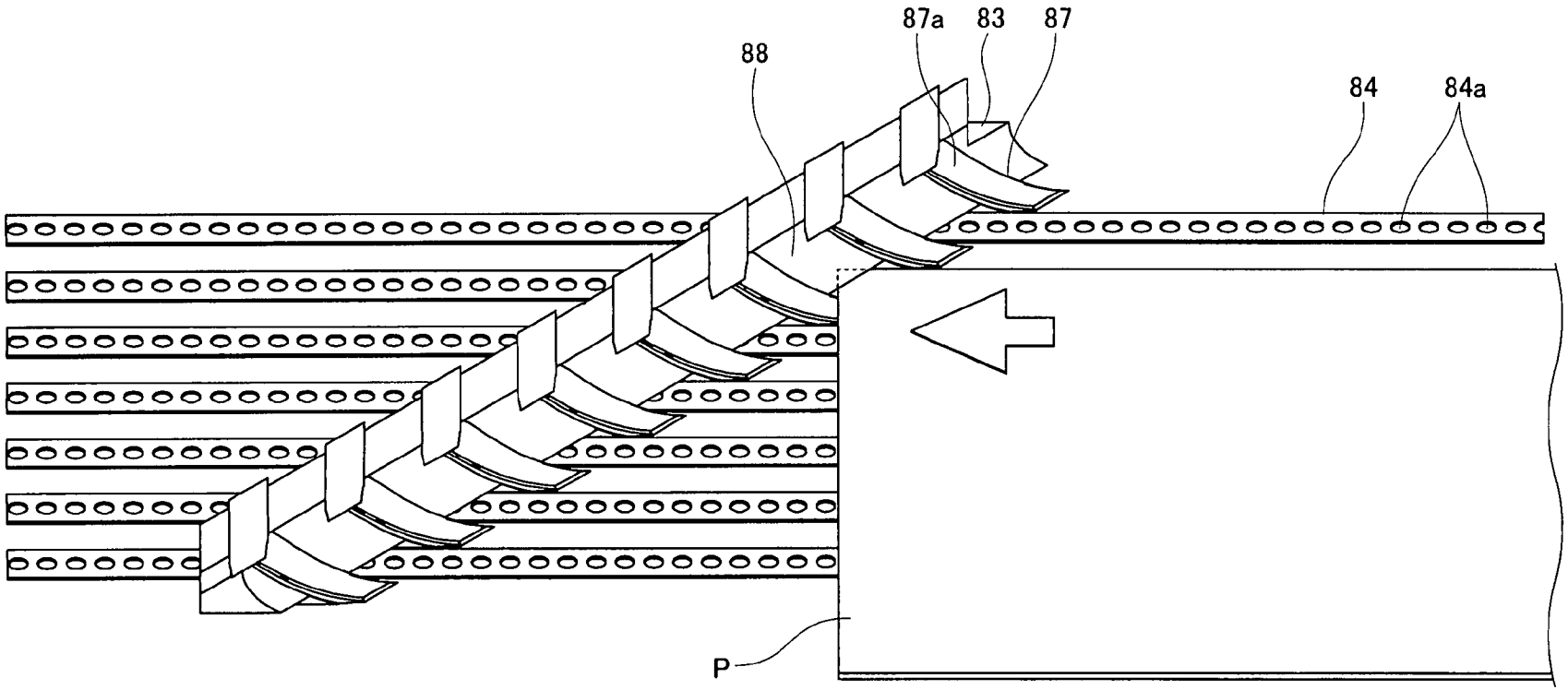
FIG. 15 is a schematic view showing a jam caused by a turn guide having no escape portions.

As shown in FIG. 15, when the escape portions 110 are not provided, the end corner on one side of the sheet P enters between the guide ribs 87 while being bent below the inverting transfer surfaces 87*a* by a curl and the like of the sheet P. In this case, the end corner comes under the guide surface 88 between the guide ribs 87 and is not inverted, thereby interfering with the inversion of an edge on the one side of the sheet P, following the end corner. Thus a paper jam occurs.

Figure 14:
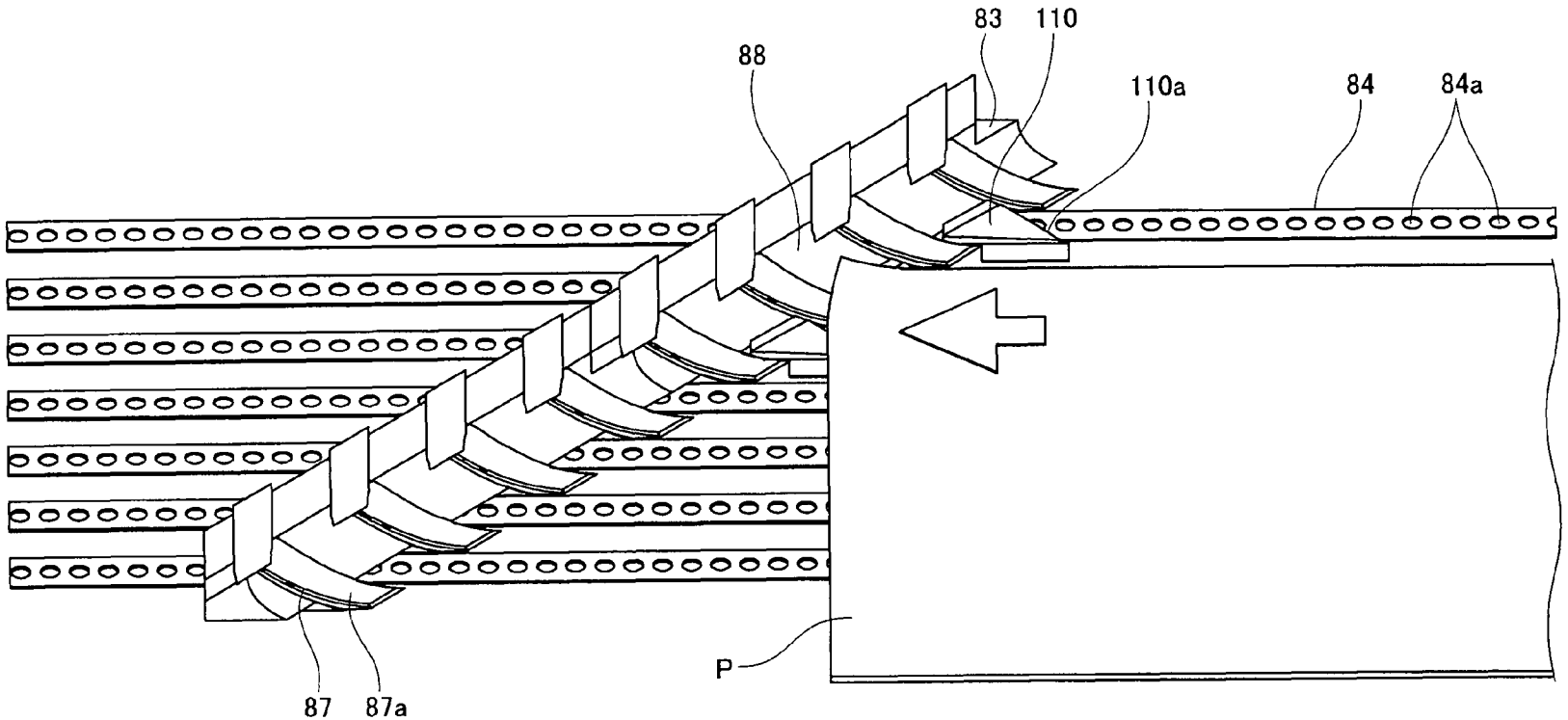
FIG. 14 is a schematic view showing the inversion of a sheet with the turn guide.

However, as shown in FIG. 14, the escape portion front ends 110*a* of the escape portions 110 are provided between the guide ribs 87 corresponding to the end corner of the sheet P and the escape portion front ends 110*a* come into slidable contact with the edge of the end corner of the sheet P which has been bent below the inverting transfer surfaces 87*a*. The escape portion front ends 110*a* are formed so as to gradually retreat in the transport direction, so that as the sheet P moves in the sheet transport direction, the escape portions 110 guide the end of the sheet upward with the escape portion front ends 110*a*, the position of the end corner on one side of the sheet P is corrected, and the end corner is smoothly inverted. Thus it is possible to prevent a paper jam.

Figure 16:
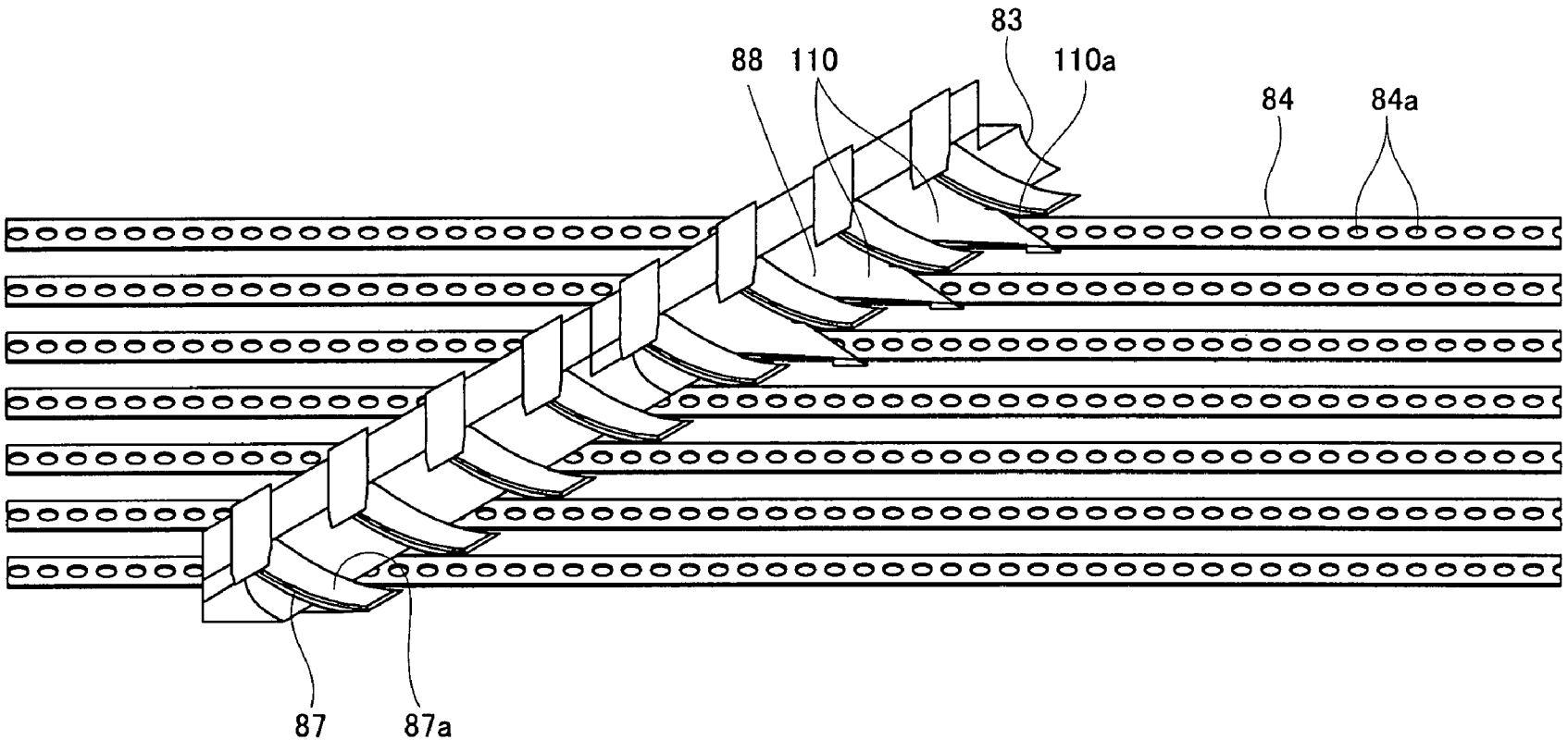
FIG. 16 is a perspective view showing a turn guide in the second sheet inverting apparatus according to the another embodiment of the present invention.
Figure 17:
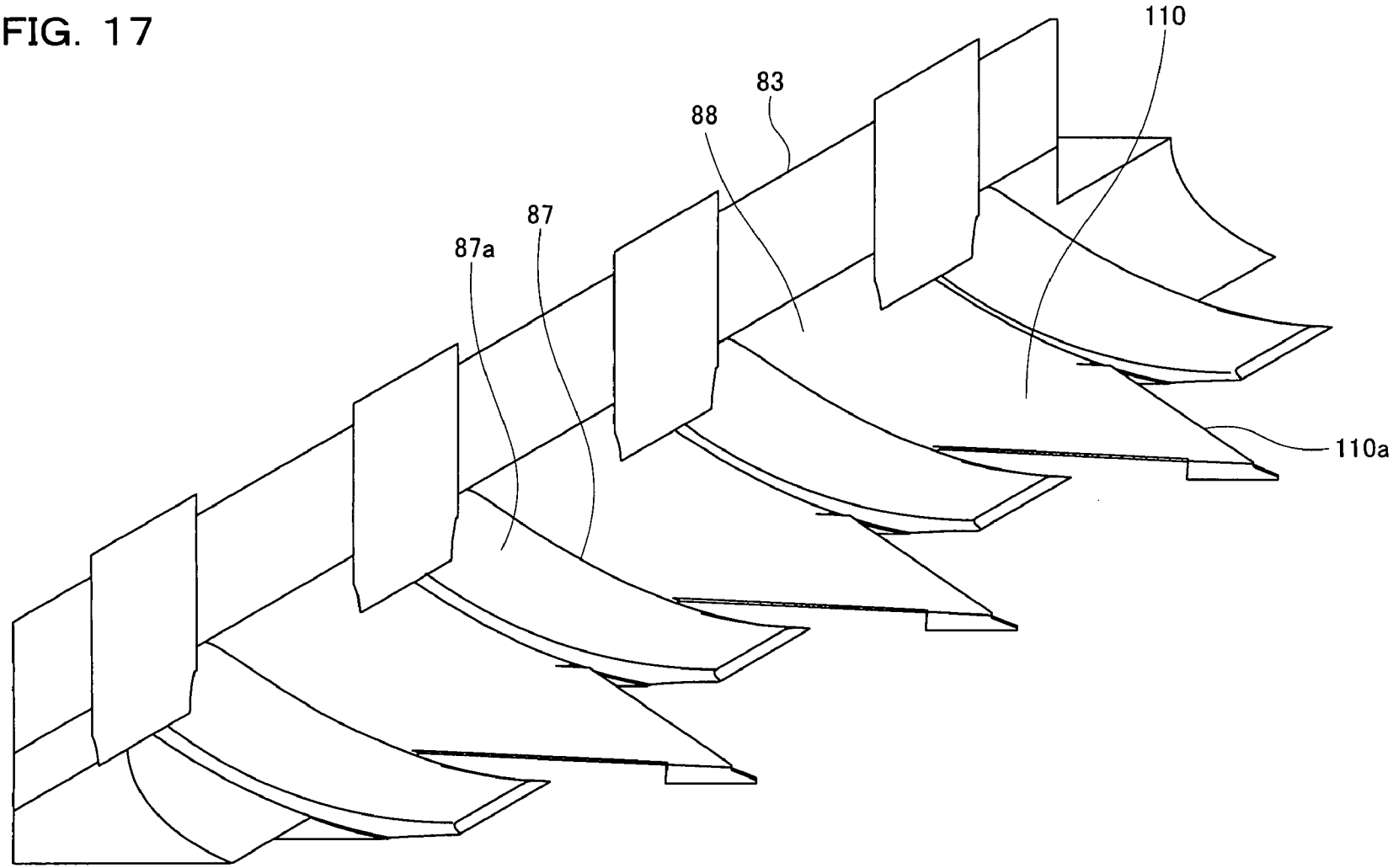
FIG. 17 is an enlarged perspective view showing the turn guide.

As shown in FIGS. 16 and 17, the escape portions 110 may be formed such that the escape portions 110 have side edges which come into contact with the guide ribs 87 disposed inside the corner of the sheet and are placed higher than the inverting transfer surfaces 87*a* of the guide ribs 87 disposed inside the corner of the sheet and the escape portion front ends 110*a* have escape portion rear ends retreated in the sheet transport direction and placed higher than the inverting transfer surfaces 87*a* of the guide ribs 87 disposed outside the corner of the sheet.

The invention claimed is:

1. A sheet transport apparatus comprising a suction device for sucking a sheet of paper on transport belts through suction holes formed on the transport belts, the suction device comprising:

a plurality of suction boxes disposed along a sheet transport direction;

a suction fan device;

an inlet pipe having one end communicating with a suction side of the suction fan device and a plurality of air inlets branched on another end so as to communicate with the respective suction boxes; and an exhaust pipe having one end communicating with an exhaust side of the suction fan device and a plurality of air exhaust nozzles branched on another end so as to be opened above the respective suction boxes, air pressure detection sensors and air intake amount adjusting valves near the air inlets of the inlet pipe, air flow rate detection sensors and air exhaust amount adjusting valves near the air exhaust nozzles of the exhaust pipe, and a controller for controlling an opening of the air intake amount adjusting valve according to a detected value of the air pressure detection sensor, and an opening of the air exhaust amount adjusting valve according to a detected value of the air flow rate detection sensor, wherein air is jetted from the air exhaust nozzles to the sheet sucked on the transport belts.

2. The sheet transport apparatus according to claim 1, wherein the air exhaust nozzles of the exhaust pipe are opened in the sheet transport direction and air is jetted downstream in the sheet transport direction from the air exhaust nozzles.

3. The sheet transport apparatus according to claim 1, wherein the inlet pipe has air intake amount limiting members or the suction boxes have openings of predetermined shapes to limit air intake amounts such that a total amount of air intake amounts through branched conduits of the inlet pipe is smaller than a maximum air intake amount of the suction fan device.

4. The sheet transport apparatus according to claim 1, further comprising a controller for controlling a suction force of the suction fan device according to a kind of sheet.

5. The sheet transport apparatus according to claim 1, further comprising a sensor device for detecting a transport position of the sheet, and the controller adjusts, based on an output of the sensor device, at least one of air intake timing for sucking air from openings of the suction boxes and exhaust timing for jetting air from the air exhaust nozzles to the sheet on the transport belts.

6. The sheet transport apparatus according to claim 1, further comprising a heating device in a conduit upstream from a branch point of the exhaust pipe.

7. The sheet transport apparatus according to claim 1, further comprising an external exhaust valve communicating with a conduit upstream from a branch point of the exhaust pipe, and an air pressure detection sensor in a conduit upstream from the external exhaust valve.

* * * * *